US006482471B1

(12) United States Patent
Suzuki

(10) Patent No.: US 6,482,471 B1
(45) **Date of Patent: *Nov. 19, 2002**

(54) IMAGE-FORMING SUBSTRATE COATED WITH LAYER OF MICROCAPSULES

(75) Inventor: Minoru Suzuki, Tochigi (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/376,278

(22) Filed: Aug. 18, 1999

(30) Foreign Application Priority Data

Aug. 18, 1998 (JP) ..... 10-231751
Mar. 4, 1999 (JP) ..... 11-057698

(51) Int. Cl.[7] ..... B41M 5/36

(52) U.S. Cl. ..... 427/256; 427/369; 427/370; 427/375; 428/195; 428/321.3; 428/484; 428/913; 428/914

(58) Field of Search ..... 428/321.3, 913, 428/914, 484, 488.1, 488.4; 427/256, 369, 370, 375

(56) References Cited

U.S. PATENT DOCUMENTS 4,525,428 A * 6/1985 Matsushita et al. ..... 428/488.1
4,644,376 A 2/1987 Usami et al. ..... 346/215
5,104,767 A 4/1992 Nakamura ..... 430/188
6,139,914 A 10/2000 Suzuki et al. ..... 427/213.3

FOREIGN PATENT DOCUMENTS

| | | | |
|---|---|---|---|
| GB | 2193687 | 2/1988 | |
| JP | 61137787 | 6/1986 | |
| JP | 63-19294 | 1/1988 | |
| JP | 3-178475 | 8/1991 | ..... 428/138 |
| JP | 4-4960 | 1/1992 | |

OTHER PUBLICATIONS

English Language Abstract of JP 61–137787.

* cited by examiner

*Primary Examiner*—Bruce H. Hess
(74) *Attorney, Agent, or Firm*—Greenblum & Bernstein, P.L.C.

(57) ABSTRACT

In an image-forming substrate, a layer of microcapsules is coated over a sheet of paper, and contains at least one type of microcapsule filled with a solid ink. A shell element of each microcapsule is constituted so as to be squashed and broken under a predetermined pressure when the solid ink of each microcapsule is thermally melted at a predetermined temperature to discharge thermally-molten ink from the squashed and broken microcapsule.

62 Claims, 24 Drawing Sheets

FIG. 27

TABLE I

| IMAGE-PIXEL SIGNAL (C) | 3-BIT GRADATION SIGNAL | HEATING-TEMPERATURE |
|---|---|---|
| [0] | | (NOT ENERGIZED) |
| [1] | [000] | 62°C |
| [1] | [001] | 66°C |
| [1] | [010] | 70°C |
| [1] | [011] | 74°C |
| [1] | [100] | 78°C |
| [1] | [101] | 82°C |
| [1] | [110] | 86°C |
| [1] | [111] | 90°C |

FIG. 28

TABLE II

| IMAGE-PIXEL SIGNAL (M) | 3-BIT GRADATION SIGNAL | HEATING-TEMPERATURE |
|---|---|---|
| [0] | | (NOT ENERGIZED) |
| [1] | [000] | 103°C |
| [1] | [001] | 106°C |
| [1] | [010] | 109°C |
| [1] | [011] | 112°C |
| [1] | [100] | 114°C |
| [1] | [101] | 116°C |
| [1] | [110] | 118°C |
| [1] | [111] | 120°C |

FIG. 29

TABLE III

| IMAGE-PIXEL SIGNAL (Y) | 3-BIT GRADATION SIGNAL | HEATING-TEMPERATURE |
|---|---|---|
| [0] | | (NOT ENERGIZED) |
| [1] | [000] | 133°C |
| [1] | [001] | 136°C |
| [1] | [010] | 139°C |
| [1] | [011] | 142°C |
| [1] | [100] | 144°C |
| [1] | [101] | 146°C |
| [1] | [110] | 148°C |
| [1] | [111] | 150°C |

IMAGE-FORMING SUBSTRATE COATED WITH LAYER OF MICROCAPSULES

BACKGROUND OF THE INVENTION

1. Field of the Invention

The present invention relates to an image-forming substrate, coated with a layer of microcapsules filled with dye, on which an image is formed by selectively squashing or breaking the microcapsules in the layer of microcapsules.

2. Description of the Related Art

In a conventional type of image-forming substrate coated with a layer of microcapsules filled with liquid dye or ink, a shell of each microcapsule is formed from a suitable photo-setting resin, and an optical image is recorded and formed as a latent image on the layer of microcapsules by exposing it to light rays in accordance with image signals. Then, the microcapsules, which are not exposed to the light rays, are broken, whereby the dye or ink discharges out of the broken microcapsules, and thus the latent image is visually developed by the discharging of the dye or ink.

Of course, each of the conventional image-forming substrates must be packed so as to be protected from being exposed to light, resulting in a wastage of materials. Further, due to the softness of unexposed microcapsules, the image-forming substrates must be handled such that they are not subjected to excess pressure, resulting in an undesired discharging of the dye or ink.

Also, an image-forming substrate, coated with a layer of microcapsules filled with different color dyes or inks, is known. The respective different colors are selectively developed on the image-forming substrate by applying specific temperatures to the layer of color microcapsules. In this case, it is necessary to fix a developed color by irradiation, using a light of a specific wavelength. Accordingly, this color-image-forming system is costly, because an additional irradiation apparatus for the fixing of a developed color is needed, and electric power consumption is increased due to the additional irradiation apparatus. Also, since a heating process for the color development and an irradiation process for the fixing of a developed color must be carried out with respect to each color, this hinders a quick formation of a color image on the color-image-forming substrate.

SUMMARY OF THE INVENTION

Therefore, an object of the present invention is to provide an image-forming substrate coated with a layer of microcapsules filled with ink, in which an image can be quickly formed on the image-forming substrate at a low cost, without producing a large amount of waste material.

Another object of the present invention is to provide microcapsules, used in the image-forming substrate, which are filled with ink exhibiting a solid phase at normal ambient temperature.

In accordance with a first aspect of the present invention, there is provided an image-forming substrate which comprises a base member, such as a sheet of paper, and a layer of microcapsules, coated over the sheet of paper, containing at least one type of microcapsule filled with a solid ink. A shell of each microcapsule is constituted so as to be squashed and broken under a predetermined pressure when the solid ink of each microcapsule is thermally melted at a predetermined temperature, whereby discharge of the thermally-molten ink from the squashed and broken microcapsule occurs.

The solid ink may be composed of a pigment and a vehicle that disperses the pigment. The vehicle may comprise a wax material. Preferably, the wax material is carnauba wax, olefin wax, polypropylene wax, microcrystalline wax, paraffin wax, montan wax or the like. The vehicle may comprise a thermoplastic resin material having a low-melting point. Preferably, the low-melting thermoplastic resin material comprises ethylene-vinyl acetate copolymer, polyethylene, polyester, and styrene-methylmethacrylate copolymer or the like. For a cyan pigment, a magenta pigment and a yellow pigment, phthalocyanine blue, rhodamine lake T and benzine yellow G may be utilized, respectively.

The shell of each microcapsule may be formed of a thermosetting resin material. Preferably, the thermosetting resin material comprises melamine resin, urea resin or the like. The shell of each microcapsule may be formed of a thermoplastic resin material exhibiting a high-melting point, which is considerably higher than the aforementioned predetermined temperature. Preferably, the high-melting thermoplastic resin material comprises polyamide, polyimide or the like. Also, the shell of each microcapsule may be formed of inorganic material, such as titanium dioxide, silica or the like. Usually, an outer surface of the shell of each microcapsule is colored by a same single color pigment as a single color exhibited by the sheet of paper.

In accordance with a second aspect of the present invention, there is provided an image-forming substrate, which comprises a base member, such as a sheet of paper, a layer of microcapsules, coated over the sheet of paper, containing a firs t type of microcapsule filled with a first monochromatic solid ink and a second type of microcapsule filled with a second monochromatic solid ink. A shell of the first type of microcapsule is constituted so as to be squashed and broken under a first predetermined pressure when the first monochromatic solid ink of the first type of microcapsule is thermally melted at a first predetermined temperature, whereby discharge of the thermally-molten ink from the squashed and broken microcapsule occurs, and a shell of the second type of microcapsule is constituted so as to be squashed and broken under a second predetermined pressure when the second monochromatic solid ink of the second type of microcapsule is thermally melted at a second predetermined temperature, whereby discharge of the thermally-molten ink from the squashed and broken microcapsule occurs. The first predetermined temperature is lower than the second predetermined temperature, and the first predetermined pressure is higher than the second predetermined pressure, whereby the first and second types of microcapsules are selectively squashed and broken within a localized area of the layer of microcapsules by selectively exerting a first set of the first predetermined temperature and the first predetermined pressure and a second set of the second predetermined temperature and the second predetermined pressure on the localized area of the layer of microcapsules.

The first monochromatic solid ink may be composed of a first pigment and a first vehicle dispersing the first pigment, and the second monochromatic solid ink maybe composed of a second pigment and a second vehicle dispersing the second pigment. When the first vehicle comprises a first wax material, the second vehicle comprises a second wax material exhibiting a melting point higher than that of the first wax material. Also, when the first vehicle comprises a first low-melting thermoplastic resin material, the second vehicle comprises a second low-melting thermoplastic resin material exhibiting a melting point higher than that of the first low-melting thermoplastic resin material.

The shells of the first and second types of microcapsules may be formed of a same material. In this case, a thickness of the shell of the first type of microcapsule is thicker than that of the shell of the second type of microcapsule such that the shell of the first type of microcapsule is durable against the second predetermined pressure, without being squashed and broken, under the second predetermined temperature. Preferably, the shells of the first and second types of microcapsules are formed of a thermosetting resin material, a thermoplastic resin material exhibiting a high-melting point which is considerably higher than the first and second predetermined temperatures, an inorganic material or the like. An outer surface of each shell of the first and second types of microcapsules may be colored by a same single color pigment as a single color exhibited by the sheet of paper.

In accordance with a third aspect of the present invention, there is provided an image-forming substrate, which comprises a base member, such as a sheet of paper, and a layer of microcapsules, coated over the sheet of paper, containing at least one type of microcapsule filled with a solid ink exhibiting a first monochrome, and a plurality of solid ink particles exhibiting a second monochrome. A shell of each microcapsule is constituted so as to be squashed and broken under a predetermined pressure when the solid ink is thermally melted at a first predetermined temperature, whereby discharge of the thermally-molten ink from the squashed and broken microcapsule occurs, and each of the solid ink particles is constituted so as to be thermally broken and melted under a second predetermined temperature higher than the first predetermined temperature, without being subjected to a substantial pressure.

The solid ink may be composed of a first pigment and a first vehicle dispersing the first pigment, and each of the solid ink particles may be composed of a second pigment and a second vehicle dispersing the second pigment and exhibiting a higher melting point than that of the first vehicle. When the first vehicle comprises a wax material, the second vehicle comprises a thermoplastic resin material exhibiting a higher melting point than that of the first wax material. The wax material may comprise either carnauba wax or olefin wax, and the thermoplastic resin material may comprise styrene-methylmethacrylate copolymer. The shell of each microcapsule may be formed of a thermosetting resin material, a thermoplastic resin material exhibiting a high-melting point which is considerably higher than the first predetermined temperature, a suitable inorganic material or the like. An outer surface of the shell of each microcapsule and an outer surface of each solid ink particle may be colored by a same single color pigment as a single color exhibited by the sheet of paper.

In accordance with a fourth aspect of the present invention, there is provided with an image-forming substrate, which comprises a base member, such as a sheet of paper, and a layer of microcapsules, coated over the sheet of paper, containing at least a first type of microcapsule filled with a first type of first-single-color solid ink, and a second type of microcapsule filled with a second type of first-single-color solid ink. A shell of the first type of microcapsule is constituted so as to be squashed and broken under a first predetermined pressure when the first type of first-single-color solid ink is thermally melted at a first predetermined temperature, whereby discharge of the thermally-molten first-single-color solid ink from the squashed and broken microcapsule occurs, and a shell of the second type of microcapsule is constituted so as to be squashed and broken under the first predetermined pressure when the second type of first-single-color solid ink is thermally melted at a second predetermined temperature, whereby discharge of the thermally-molten first-single-color solid ink from the squashed and broken microcapsule occurs. The first predetermined temperature is lower than the second predetermined temperature, whereby the first and second types of microcapsules are selectively squashed and broken within a localized area of the layer of microcapsules by selectively exerting a set of the first predetermined temperature and the first predetermined pressure and a set of the second predetermined temperature and the first predetermined pressure on the localized area of the layer of microcapsules, resulting in a variation in density of the first-single-color solid ink discharged within the localized area of the layer of microcapsules.

The first type of first-single-color solid ink may exhibit either a same density as that of the second type of first-single-color solid ink or a density different from that of the second type of first-single-color solid ink.

In the fourth aspect of the present invention, the layer of microcapsules may further comprise a third type of microcapsule filled with a first type of second-single-color solid ink, and a fourth type of microcapsule filled with a second type of second-single-color solid ink. In this case, a shell of the third type of microcapsule is constituted so as to be squashed and broken under a second predetermined pressure when the first type of second-single-color solid ink is thermally melted at a third predetermined temperature, whereby discharge of the thermally-molten second-single-color solid ink from the squashed and broken microcapsule occurs, and a shell of the fourth type of microcapsule is constituted so as to be squashed and broken under the second predetermined pressure when the second type of second-single-color solid ink is thermally melted at a fourth predetermined temperature, whereby discharge of the thermally-molten second-single-color solid ink from the squashed and broken microcapsule occurs. The third predetermined temperature is lower than the fourth predetermined temperature, whereby the third and fourth types of microcapsules are selectively squashed and broken within a localized area of the layer of microcapsules by selectively exerting a set of the third predetermined temperature and the second predetermined pressure and a set of the fourth predetermined temperature and the second predetermined pressure on the localized area of the layer of microcapsules, resulting in a variation in density of the second-single-color solid ink discharged within the localized area of the layer of microcapsules.

The first type of second-single-color solid ink may exhibit either a same density as that of the second type of second-single-color solid ink of a density different from that of the second type of second-single-color solid ink.

In accordance with a fifth aspect of the present invention, there is provided with an image-forming substrate, which comprises a base member, such as a sheet of paper, and a layer of microcapsules, coated over the sheet of paper, containing at least a first type of microcapsule filled with a first type of first-single-color solid ink, and a second type of microcapsule filled with a second type of first-single-color solid ink. A shell of the first type of microcapsule is constituted so as to be squashed and broken under a first predetermined pressure when the first type of first-single-color solid ink is thermally melted at a first predetermined temperature, whereby discharge of the thermally-molten first-single-color solid ink from the squashed and broken microcapsule occurs, and a shell of the second type of microcapsule is constituted so as to be squashed and broken under a second predetermined pressure when the second type of first-single-color solid ink is thermally melted at a second predetermined temperature, whereby discharge of the thermally-molten first-single-color solid ink from the squashed and broken microcapsule occurs. The first predetermined temperature is lower than the second predetermined temperature, and the first predetermined pressure is higher than the second predetermined pressure, whereby the first and second types of microcapsules are selectively squashed and broken within a localized area of the layer of microcapsules by selectively exerting a set of the first predetermined temperature and the first predetermined pressure and a set of the second predetermined temperature and the second predetermined pressure on the localized area of the layer of microcapsules, resulting in a variation in density of the first-single-color solid ink discharged within the localized area of the layer of microcapsules.

Similar to the fourth aspect of the present invention, the first type of first-single-color solid ink may exhibit either a same density as that of the second type of first-single-color solid ink or a density different from that of the second type of first-single-color solid ink.

In the fifth aspect of the present invention, the layer of microcapsules may further comprise a third type of microcapsule filled with a first type of second-single-color solid ink, and a fourth type of microcapsule filled with a second type of second-single-color solid ink. A shell of the third type of microcapsule is constituted so as to be squashed and broken under a third predetermined pressure when the first type of second-single-color solid ink is thermally melted at a third predetermined temperature, whereby discharge of the thermally-molten second-single-color solid ink from the squashed and broken microcapsule occurs, and a shell of the fourth type of microcapsule is constituted so as to be squashed and broken under a fourth predetermined pressure when the second type of second-single-color solid ink is thermally melted at a fourth predetermined temperature, whereby discharge of the thermally-molten second-single-color solid ink from the squashed and broken microcapsule occurs. The third predetermined temperature is lower than the fourth predetermined temperature, and the third predetermined pressure is higher than the fourth predetermined pressure, whereby the third and fourth types of microcapsules are selectively squashed and broken within a localized area of the layer of microcapsules by selectively exerting a set of the third predetermined temperature and the third predetermined pressure and a set of the fourth predetermined temperature and the fourth predetermined pressure on the localized area of the layer of microcapsules, resulting in a variation in density of the second-single-color solid ink discharged within the localized area of the layer of microcapsules.

Similar to the fourth aspect of the present invention, the first type of second-single-color solid ink may exhibit either a same density as that of the second type of second-single-color solid ink or a density different from that of the second type of second-single-color solid ink.

In accordance with a sixth aspect of the present invention, there is provided with an image-forming substrate, which comprises a base member, such as a sheet of paper, and a layer of microcapsules, coated over the sheet of paper, containing at least a first type of microcapsule filled with a first monochromatic solid ink exhibiting a melting point which falls within a first predetermined range of temperature. A shell of the first type of microcapsule is constituted so as to be squashed and broken under a first predetermined pressure when the first monochromatic solid ink, encapsulated in the shell concerned, is thermally melted under a temperature within the first predetermined range of temperature, whereby discharge of the thermally-molten ink from the squashed and broken microcapsule occurs. The first type of microcapsule is selectively squashed and broken within a localized area of the layer of microcapsules, on which the first predetermined pressure is exerted, by regulating a temperature to be exerted on the localized area of the layer of microcapsules within the first predetermined range of temperature, resulting in a variation in density of the first monochromatic solid ink discharged within the localized area of the layer of microcapsules.

Preferably, the first type of microcapsule is completely squashed and broken within the localized area of the layer of microcapsules when a maximum temperature, within the first predetermined range of temperature, is exerted on the localized area of the layer of microcapsules.

In the sixth aspect of the present invention, the layer of microcapsules may further comprise a second type of microcapsule filled with a second monochromatic solid ink exhibiting a melting point which falls within a second predetermined range of temperature. A shell of the second type of microcapsule is constituted so as to be squashed and broken under a second predetermined pressure when the second monochromatic solid ink, encapsulated in the shell concerned, is thermally melted under a temperature included in the second predetermined range of temperature, whereby discharge of the thermally-molten ink from the squashed and broken microcapsule occurs. The second type of microcapsule is selectively squashed and broken within a localized area of the layer of microcapsules, on which the second predetermined pressure is exerted, by regulating a temperature to be exerted on the localized area of the layer of microcapsules within the second predetermined range of temperature, resulting in a variation in density of the second monochromatic solid ink discharged within the localized area of the layer of microcapsules.

Preferably, the second type of microcapsule is completely squashed and broken within the localized area of the layer of microcapsules when a maximum temperature, within the second predetermined range of temperature, is exerted on the localized area of the layer of microcapsules.

In accordance with a seventh aspect of the present invention, there is provided with a microcapsule which comprises a shell element, and a solid ink, encapsulated in the shell element, exhibiting a predetermined melting point. The shell element is constituted so as to be squashed and broken at a predetermined temperature when the solid ink is thermally melted at the predetermined temperature.

Similar to the first aspect of the present invention, the solid ink may be composed of a pigment and a vehicle that disperses the pigment, the shell of each microcapsule may be formed of a thermosetting resin material, a thermoplastic resin material exhibiting a high-melting point, which is considerably higher than the predetermined temperature and an inorganic material.

BRIEF DESCRIPTION OF THE DRAWINGS

These objects and other objects of the present invention will be better understood from the following description, with reference to the accompanying drawings in which:

FIG. 27 is a table showing a relationship between a digital cyan image-pixel signal carrying a 3-bit gradation-signal and a variation in a heating temperature of a corresponding electric resistance element included in a cyan thermal head for producing a cyan dot on the image-forming substrate shown in FIG. 25;

FIG. 28 is a table showing a relationship between a digital magenta image-pixel signal carrying a 3-bit gradation-signal and a variation in a heating temperature of a corresponding electric resistance element included in a magenta thermal head for producing a magenta dot on the image-forming substrate shown in FIG. 25; and FIG. 29 is a table showing a relationship between a digital yellow image-pixel signal carrying a 3-bit gradation-signal and a variation in a heating temperature of a corresponding electric resistance element included in a yellow thermal head for producing a yellow dot on the image-forming substrate shown in FIG. 25.

DESCRIPTION OF THE PREFERRED EMBODIMENTS

Figure 1:
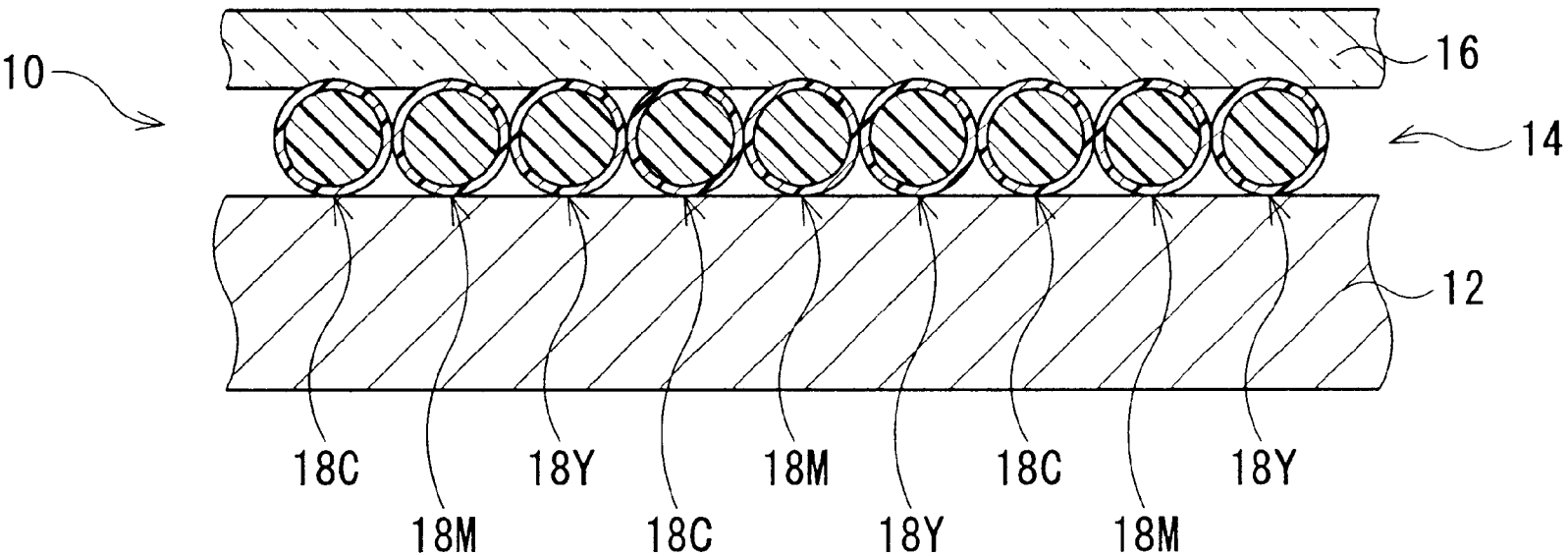
FIG. 1 is a schematic conceptual cross sectional view showing a first embodiment of an image-forming substrate, according to the present invention, comprising a layer of microcapsules including a first type of microcapsule filled with a solid cyan-ink, a second type of microcapsule filled with a solid magenta ink and a third type of microcapsule filled with a solid yellow-ink.

FIG. 1 shows a first embodiment of an image-forming substrate, generally indicated by reference 10, which is a paper sheet. In particular, the image-forming substrate 10 comprises a sheet of paper 12, a layer of microcapsules 14 coated over a surface of the sheet of paper 12, and a sheet of protective transparent film or ultraviolet barrier film 16 covering the layer of microcapsules 14.

In the first embodiment, the layer of microcapsules 14 is formed from three types of microcapsules: a first type of microcapsule 18C filled with a solid cyan-ink, a second type of microcapsule 18M filled with a solid magenta-ink, and a third type of microcapsule 18Y filled with a solid yellow-ink, and the three types of microcapsules 18C, 18M and 18Y are uniformly distributed in the layer of microcapsules 14. Note, each type of microcapsule (18C, 18M, 18Y) may have an average diameter of several microns, for example, 5$\mu$ to 10$\mu$.

For the uniform formation of the layer of microcapsules 14, for example, the same amounts of cyan, magenta and yellow microcapsules 18C, 18M and 18Y are homogeneously mixed with a wax-type binder solution to form a suspension, and the sheet of paper 12 is coated with the wax-type binder solution, containing the suspension of microcapsules 18C, 18M and 18Y, by using an atomizer. In FIG. 1, for the convenience of illustration, although the layer of microcapsules 14 is shown as having a thickness corresponding to the diameter of the microcapsules 18C, 18M and 18Y, in reality, the three types of microcapsules 18C, 18M and 18Y overlay each other, and thus the layer of microcapsules 14 has a larger thickness than the diameter of a single microcapsule 18C, 18M or 18Y.

Usually, in each type of microcapsule (18C, 18M, 18Y), a shell of a microcapsule is colored white because, in general, the sheet of paper 12 is white. Of course, if the sheet of paper 12 is colored with a single color pigment, the shell of the microcapsule (18C, 18M, 18Y) may be colored by the same single color pigment.

In each type of microcapsule (18C, 18M, 18Y), a solid-ink is composed of a monochromatic pigment, and a vehicle for dispersing the pigment. The vehicle may comprise a wax material, such as carnauba wax, olefin wax, polypropylene wax, microcrystalline wax, paraffin wax, montan wax or the like. Also, the vehicle may comprise a low-melting thermoplastic resin, such as ethylene-vinyl acetate copolymer (EVA), polyethylene, polyester, styrene-methylmethacrylate copolymer.

In this first embodiment, for the solid cyan-ink of the first type of microcapsule 18C, carnauba wax is utilized as a vehicle, and a cyan pigment, such as phthalocyanine blue, is incorporated in the carnauba wax. As shown in a graph of FIG. 2, the carnauba wax, and therefore the carnauba-wax-type cyan-ink, exhibits a characteristic curve of a coefficient of elasticity, indicated by reference $E_c$, with respect to a variation in temperature. Namely, this carnauba-wax type cyan-ink is thermally plasticized at a temperature of from about 70° C. to about 75° C., and is completely and thermally melted at a temperature of about 83° C.

Figure 2:
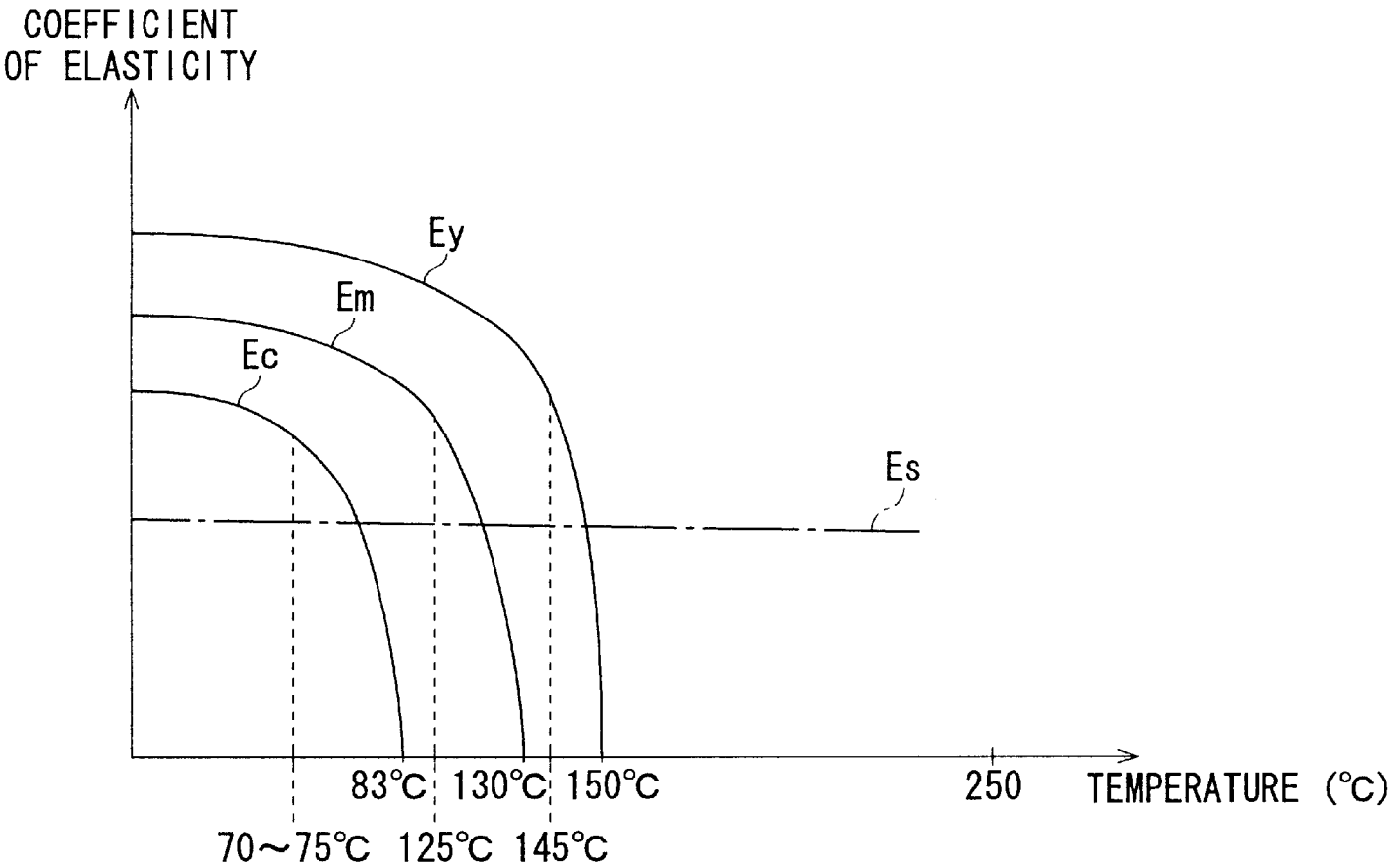
FIG. 2 is a graph showing characteristic curves of longitudinal elasticity coefficients of the solid cyan-ink, solid magenta-ink, and solid yellow-ink of the first, second and third types of microcapsules shown in FIG. 1.

Also, for the solid magenta-ink of the second type of microcapsule 18M, olefin wax is utilized as a vehicle, and a magenta pigment, such as rhodamine lake T, is incorporated in the olefin wax. As shown in the graph of FIG. 2, the olefin wax, and therefore the olefin-wax-type magenta-ink, exhibits a characteristic curve of a coefficient of elasticity, indicated by reference $E_m$, with respect to a variation in temperature. Namely, this olefin-wax-type magenta-ink is thermally plasticized at a temperature of about 125° C., and is completely and thermally melted at a temperature of about 130° C.

Further, for the solid yellow-ink of the third type of microcapsule 18Y, polypropylene wax is utilized as a vehicle, and a yellow pigment, such as benzine yellow G, is incorporated in the polypropylene wax. As shown in the graph of FIG. 2, the polypropylene wax, and therefore polypropylene-wax-type yellow-ink exhibits a characteristic curve of a coefficient of elasticity, indicated by reference $E_y$, with respect to a variation in temperature. Namely, this polypropylene-wax-type yellow-ink is thermally plasticized at a temperature of about 145° C., and is completely and thermally melted at a temperature of about 150° C.

On the other hand, in each type of microcapsule (18C, 18M, 18Y), a shell of a microcapsule may be formed of a thermosetting resin such as melamine resin, urea resin or the like. Optionally, for the shell material of each type of microcapsule (18C, 18M, 18Y), a thermoplastic resin exhibiting a relatively high-melting point, e.g., more than 250° C., such as polyamide, polyimide or the like, may be utilized. Further, optionally, for the material of each type of microcapsule (18C, 18M, 18Y), it is possible to utilize a suitable inorganic material exhibiting white, such as titanium dioxide, silica or the like.

In this first embodiment, the shell of each type of microcapsule (18C, 18M, 18Y) is formed of melamine resin. As shown in the graph of FIG. 2, the melamine resin concerned exhibits a characteristic curve of a coefficient of elasticity, indicated by reference $E_s$, with respect to a variation in a temperature. Namely, the coefficient of elasticity of the melamine resin is substantially constant with respect to a variation in temperature over a range between 0° C. and 250° C.

Figure 3:
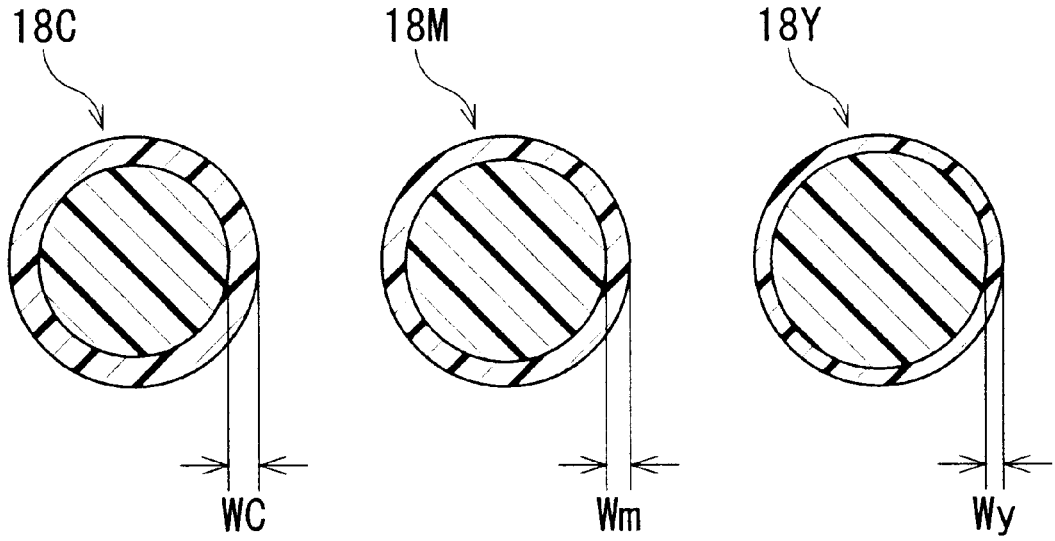
FIG. 3 is a schematic cross sectional view showing different shell thicknesses of the first, second and third types of microcapsules shown in FIG. 1.

In the first embodiment, although the shells of the three types of microcapsules 18C, 18M and 18Y are formed of the melamine resin, the shells of the cyan microcapsule 18C, magenta microcapsule 18M, and yellow microcapsule 18Y have differing shell thicknesses $W_c$, $W_m$ and $W_y$, respectively, as shown in FIG. 3. The shell thickness $W_c$ of cyan microcapsule 18C is thicker than the shell thickness $W_m$ of the magenta microcapsule 18M, and the shell thickness $W_m$ of the magenta microcapsule 18M is thicker than the shell thickness $W_y$ of the yellow microcapsule 18Y.

Each type of microcapsules (18C, 18M, 18Y) can endure a considerably high pressure without being squashed and broken as long as a corresponding solid ink, encapsulated therein, exhibits a solid-phase under a normal ambient temperature. Nevertheless, each microcapsule (18C, 18M, 18Y) is easily squashed and broken by a relatively low pressure when the corresponding solid ink is heated so as to be thermally melted, i.e., when the solid phase of the solid ink is changed into a liquid phase.

In this first embodiment, the shell thickness $W_c$ of the cyan microcapsules 18C is selected such that each cyan microcapsule 18C is squashed and broken under a pressure more than a predetermined critical pressure of 2.0 MPa when each cyan microcapsule 18C is heated to a temperature between the melting point (about 83° C.) of the cyan solid-ink and the melting point (about 125° C.) of the magenta solid-ink. The shell thickness $W_m$ of the magenta microcapsules 18M is selected such that each magenta microcapsule 18M is squashed and broken under a pressure that lies between a predetermined critical pressure of 0.2 MPa and the predetermined critical pressure of MPa when each magenta microcapsule 18M is heated to a temperature between the melting point (about 125° C.) of the magenta solid-ink and the melting point (about 145° C.) of the yellow solid-ink. The shell thickness $W_y$ of the yellow microcapsules 18Y is selected such that each yellow microcapsule 18Y is squashed and broken under a pressure that lies between a predetermined critical pressure of 0.02 MPa and the predetermined critical pressure of 0.2 MPa when each yellow microcapsule 18Y is heated to a temperature more than the melting point (about 145° C.) of the yellow solid-ink.

Figure 4:
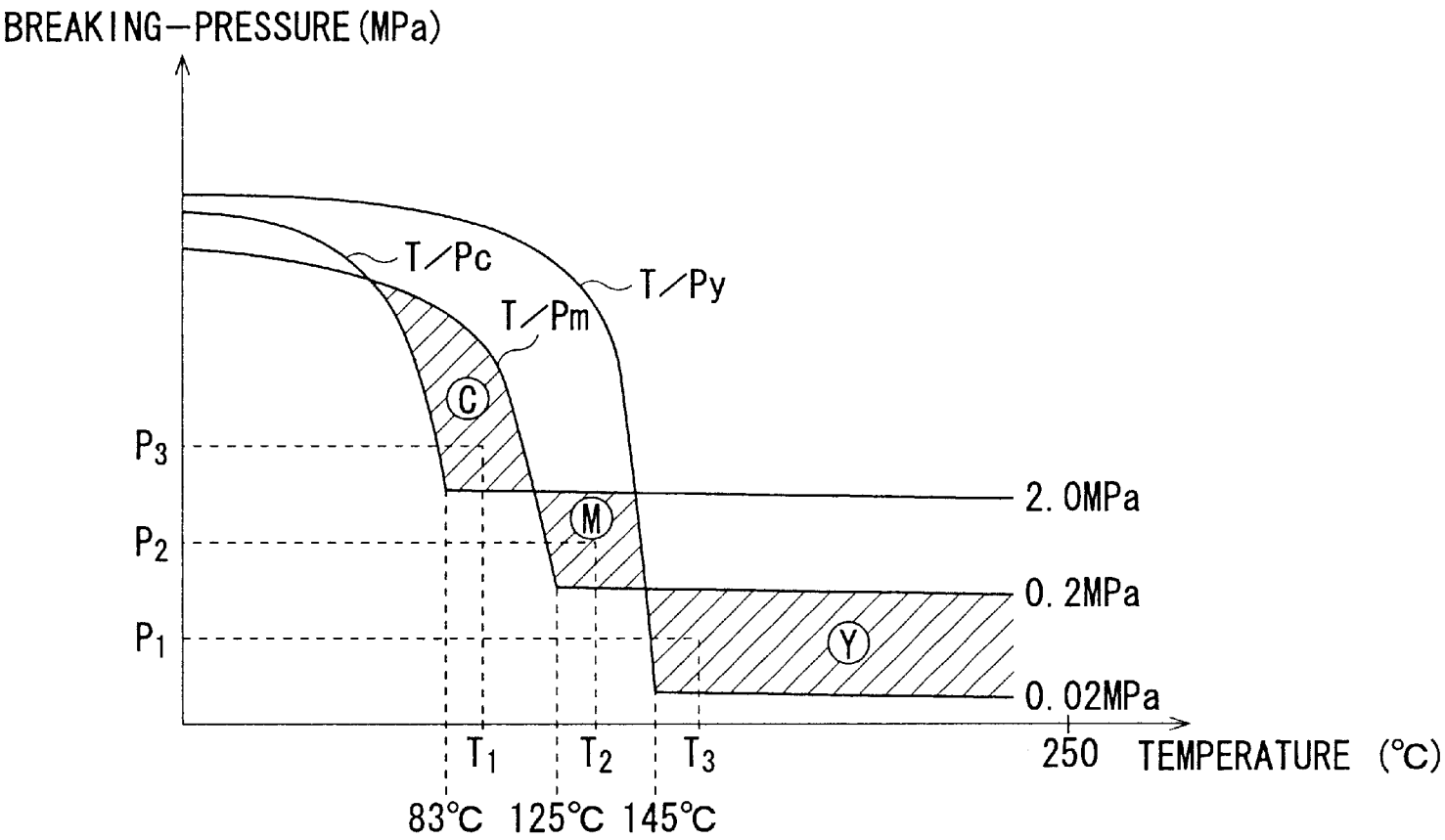
FIG. 4 is a graph showing temperature/pressure breaking characteristics of the first, second and third types of microcapsules shown in FIG. 1, with each of a cyan-developing zone, a magenta-developing zone and a yellow-developing zone being indicated as a hatched zone.

Thus, as shown in FIG. 4, it is possible to obtain a temperature/pressure breaking characteristic $T/P_c$ of the first type of microcapsule 18C, a temperature/pressure breaking characteristic $T/P_m$ of the second type of microcapsule 18M and a temperature/pressure breaking characteristic $T/P_y$ of the third type of microcapsule 18Y, and a hatched cyan-developing zone C, a hatched magenta-developing zone M and a hatched yellow-developing zone Y are defined by the characteristics $T/P_c$, $T/P_m$ and $T/P_y$. Accordingly, by suitably selecting a heating temperature and a breaking pressure, which should be locally exerted on the image-forming sheet 10, it is possible to selectively squash and break the cyan, magenta and yellow microcapsules 18C, 18M and 18Y at the localized area of the image-forming sheet 10 on which the heating temperature and the breaking pressure are exerted.

Figure 5:
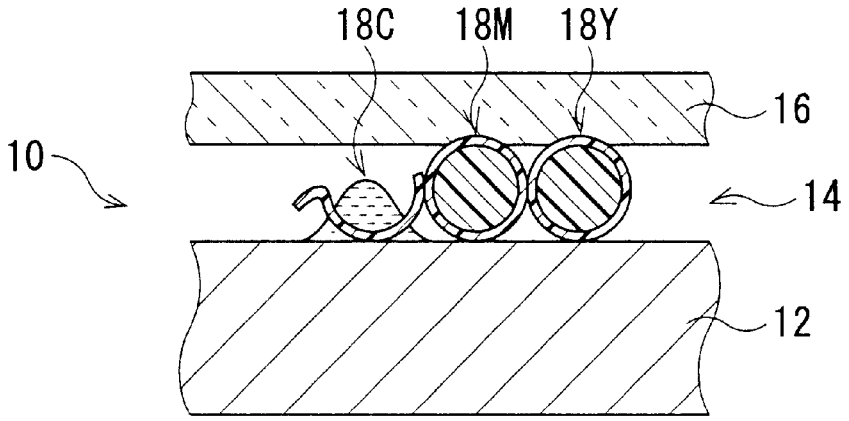
FIG. 5 is a schematic conceptual cross sectional view similar to FIG. 1, showing only a selective breakage of the first type of microcapsule in the layer of microcapsules of the image-forming substrate shown in FIG. 1.

In particular, as shown in FIG. 4, for example, if a heating temperature $T_1$ and a breaking pressure $P_3$, which should be locally exerted on the image-forming sheet 10, are selected so as to fall within the hatched cyan-developing zone C, only the cyan microcapsules 18C are squashed and broken at the localized area of the image-forming sheet 10 on which the heating temperature $T_1$ and the breaking pressure $P_3$ are exerted, resulting in discharge of the molten cyan-ink from the squashed and broken microcapsules 18C, as shown in FIG. 5. At this time, both the solid magenta-ink and the solid yellow-ink, encapsulated in the respective microcapsules 18M and 18Y, cannot be thermally melted due to the heating temperature $T_1$ being lower than the melting point (about 125° C.) of the magenta solid-ink, and thus the microcapsules 18M and 18Y cannot be squashed and broken, due to the solidity of the magenta and yellow solid-inks, even if the shell thicknesses and $W_m$ and $W_y$ thereof are thinner than the shell thickness $W_c$ of the cyan microcapsule 18C.

Figure 6:
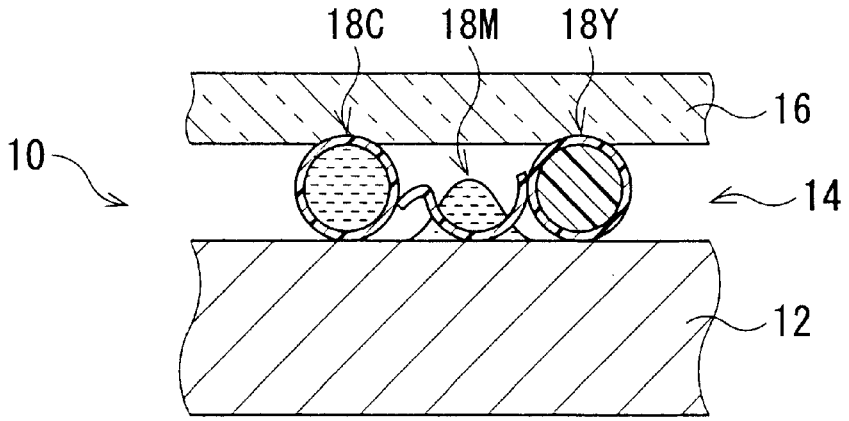
FIG. 6 is a schematic conceptual cross sectional view similar to FIG. 1, showing only a selective breakage of the second type of microcapsule in the layer of microcapsules of the image-forming substrate shown in FIG. 1.

Also, as shown in FIG. 4, if a heating temperature $T_2$ and a breaking pressure $P_2$ which should be locally exerted on the image-forming sheet 10, are selected so as to fall within the hatched magenta-developing zone M, only the magenta microcapsules 18M are squashed and broken at the localized area of the image-forming sheet 10 on which the heating temperature $T_2$ and the breaking pressure $P_2$ are exerted, resulting in discharge of the molten magenta-ink from the squashed and broken microcapsules 18M, as shown in FIG. 6. At this time, although the solid cyan-ink, encapsulated in the microcapsule 18C, is thermally melted, the cyan microcapsule 18C cannot be squashed and broken due to the shell thickness $W_c$ thereof being thicker than the shell thickness $W_m$ of the magenta microcapsule 18M wall. Of course, the solid yellow-ink, encapsulated in the yellow microcapsule 18Y, cannot be thermally melted due to the heating temperature $T_2$ being lower than the melting point (about 145° C.) of the yellow solid-ink, and thus the yellow microcapsule 18Y cannot be squashed and broken, due to the solidity of the yellow solid-ink, even if the shell thickness $W_y$ thereof is thinner than the shell thickness $W_m$ of the magenta microcapsule 18M.

Figure 7:
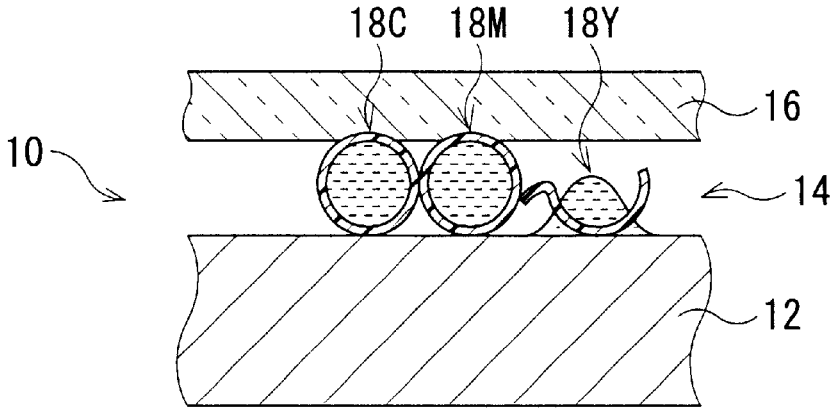
FIG. 7 is a schematic conceptual cross sectional view similar to FIG. 1, showing only a selective breakage of the third type of microcapsule in the layer of microcapsules of the image-forming substrate shown in FIG. 1.

Further, as shown in FIG. 4, if a heating temperature $T_3$ and a breaking pressure $P_1$, which should be locally exerted on the image-forming sheet 10, are selected so as to fall within the hatched yellow-developing zone Y, only the yellow microcapsules 18Y are squashed and broken at the localized area of the image-forming sheet 10 on which the heating temperature $T_3$ and the breaking pressure $P_1$ are exerted, resulting in discharge of the molten yellow-ink from the squashed and broken microcapsules 18Y, as shown in FIG. 7. At this time, although both the solid cyan-ink and solid magenta-ink, encapsulated in the cyan and magenta microcapsules 18C and 18M are thermally melted, the cyan and magenta microcapsules 18C and 18M cannot be squashed and broken due to the shell thicknesses $W_c$ and $W_m$ thereof being thicker than the shell thickness $W_y$ of the yellow microcapsule 18Y.

Accordingly, if the selection of a heating temperature and a breaking pressure, which should be locally exerted on the image-forming sheet 10, are suitably controlled in accordance with digital color image-pixel signals: digital cyan image-pixel signals, digital magenta image-pixel signals and digital yellow image-pixel signals, it is possible to form a color image on the image-forming sheet 10 on the basis of the digital color image-pixel signals.

Note, in this first embodiment, the heating temperatures $T_1$, $T_2$ and $T_3$ may be 85° C., 135° C. and 160° C., respectively, and the breaking pressures $P_1$, $P_2$ and $P_3$ may be 0.1 MPa, 1.0 MPa and 3.0 MPa, respectively.

In order to produce each of the types of microcapsules 18C, 18M and 18Y, a polymerization method, such as interfacial polymerization, in-situ polymerization or the like, may be utilized. Optionally, each of the types of microcapsules 18C, 18M and 18Y may be produced by a "HYBRIDIZER (TRADE NAME)", which is available from NARA KIKAI SEISHAKUSHO. In particular, the "HYBRIDIZER" is useful when a shell of a microcapsule is formed of an inorganic material, such as titanium dioxide, silica or the like.

For example, when a cyan solid-ink is encapsulated in a titanium dioxide shell by using the "HYBRIDIZER", cyan solid-ink material, which may be composed of carnauba wax and phthalocyanine blue, is powdered into fine particles having an average diameter of several microns ($5\mu$ to $10\mu$), and titanium dioxide material is powdered into further fine particles having an average diameter of $0.01\mu$ to $0.1\mu$. A given amount of solid-ink particles and a given amount of titanium dioxide particles are introduced into the "HYBRIDIZER", and are agitated in a high-speed air stream generated therein.

Figure 8:
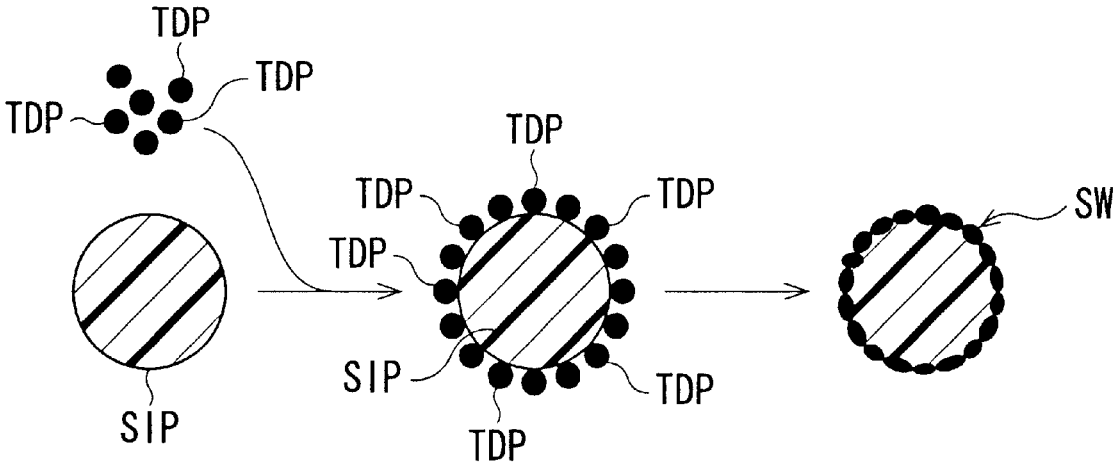
FIG. 8 is a schematic conceptual view showing, by way of example, a process for producing microcapsules each having a solid ink encapsulated therein.

With reference to FIG. 8, a solid-ink particle is indicated by reference SIP, and titanium dioxide particles are indicated by reference TDP. During the agitation of the two kinds of particles SIP and TDP in the high-speed air stream, a number of titanium dioxide particles TDP is adhered to each solid-ink particle SIP, and then the titanium dioxide particles TDP, adhered to each solid-ink particle SIP, are subjected to physical and thermal energies, thereby producing a shell wall SW around each solid-ink particle SIP, as shown in FIG. 8.

Note, of course, the "HYBRIDIZER" can be advantageously used to encapsulate a solid-ink in a thermosetting plastic resin shell or a high-melting thermoplastic resin shell.

Figure 9:
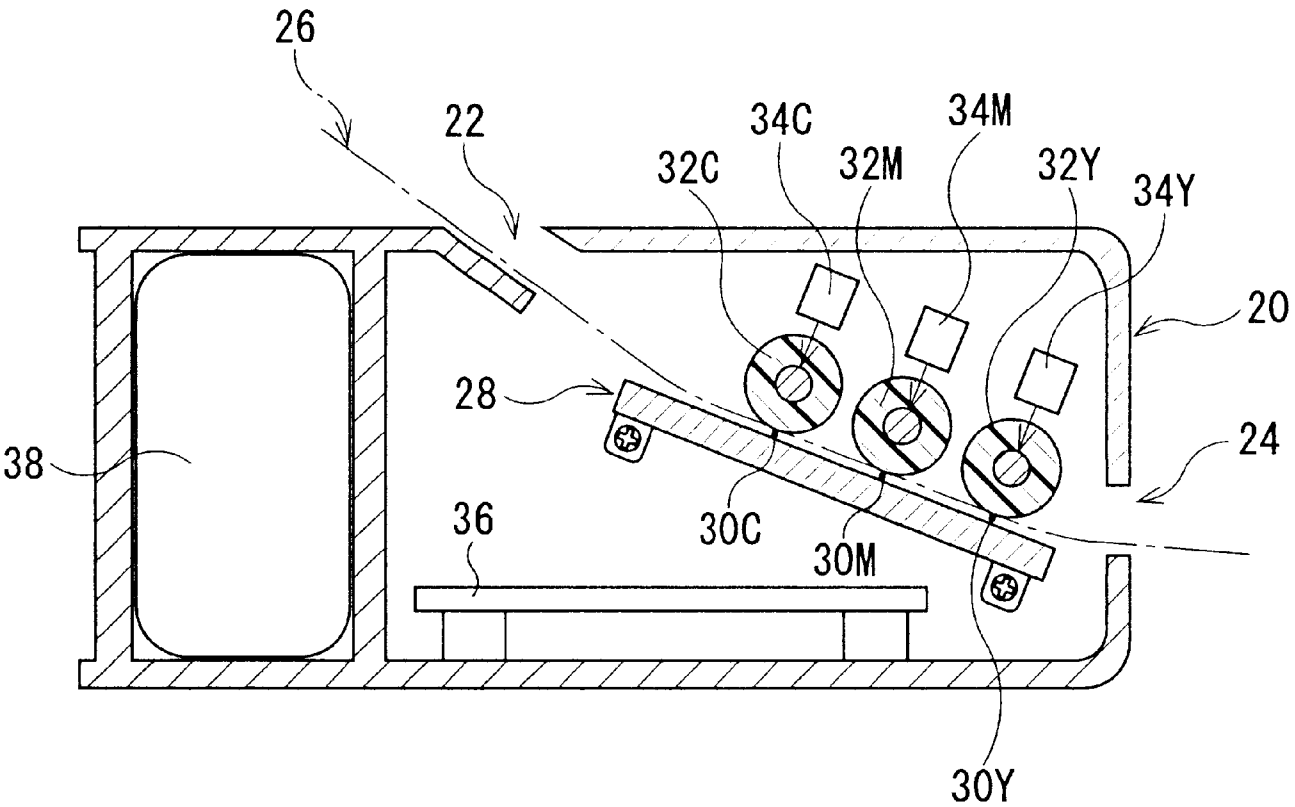
FIG. 9 is a schematic cross sectional view of a line type color printer for forming and recording a color image on the image-forming substrate shown in FIG. 1.

FIG. 9 schematically shows a color printer, which is constituted as a line printer so as to form a color image on the image-forming sheet 10.

The color printer comprises a rectangular parallelopiped housing 20 having an entrance opening 22 and an exit opening 24 formed in a top wall and a side wall of the housing 20, respectively. The image-forming sheet 10 is introduced into the housing 20 through the entrance opening 22, and is then discharged from the exit opening 24 after the formation of a color image on the image-forming sheet 10. Note, in FIG. 9, a path 26 for movement of the sheet 10 is indicated by a single-chained line.

A guide plate 28 is provided in the housing 20 so as to define a part of the path 26 for the movement of the image-forming sheet 10, and a first thermal head 30C, a second thermal head 30M and a third thermal head 30Y are securely attached to a surface of the guide plate 28. Each thermal head (30C, 30M, 30Y) is formed as a line thermal head perpendicularly extended with respect to a direction of the movement of the image-forming sheet 10.

Figure 10:
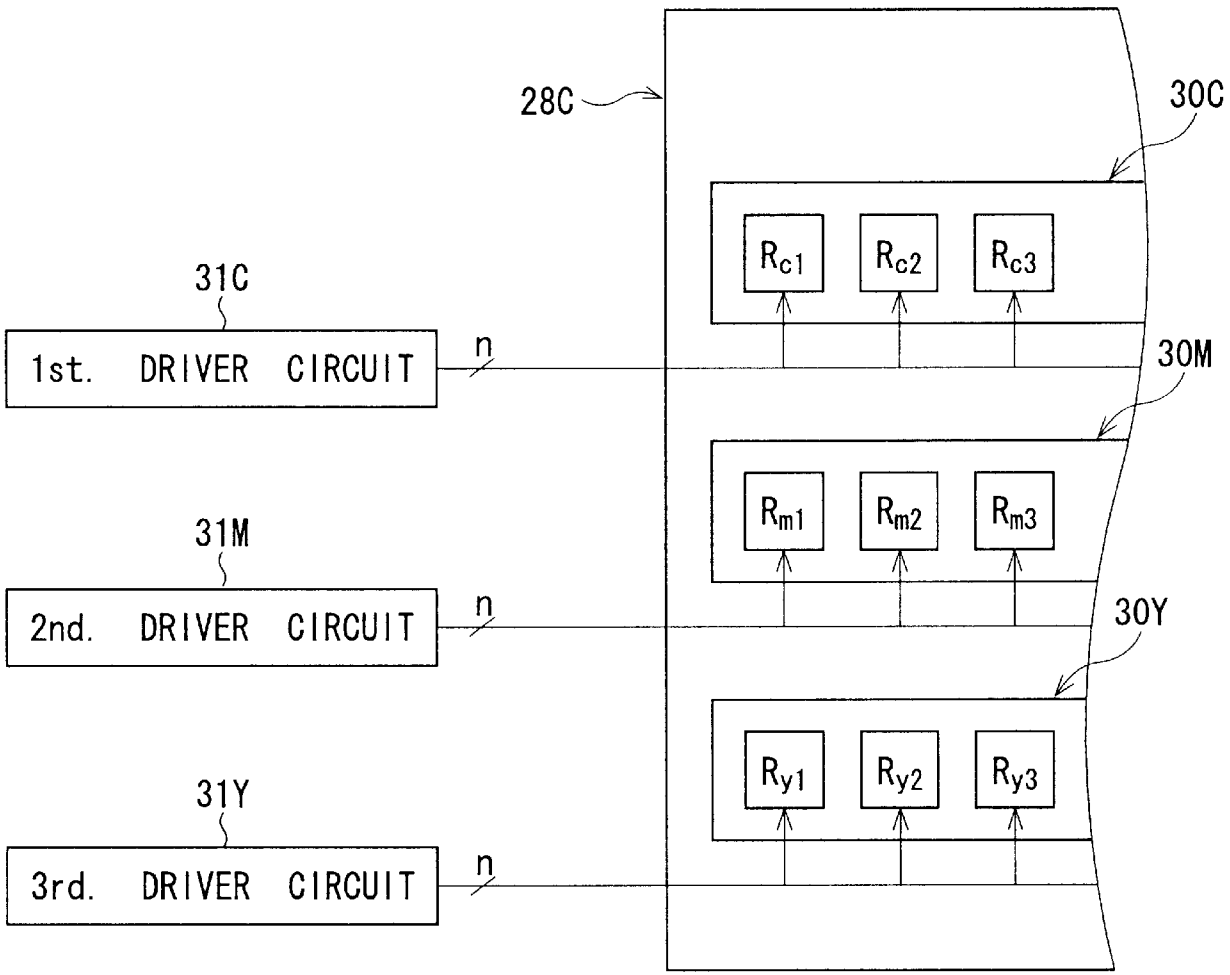
FIG. 10 is a partial schematic block diagram of three line type thermal heads and three driver circuits therefor incorporated in the line type color printer of FIG. 9.

As shown in FIG. 10, the line thermal head 30C includes a plurality of heater elements or electric resistance elements $R_{c1}$ to $R_{cn}$, and these resistance elements are aligned with each other along a length of the line thermal head 30C. The electric resistance elements $R_{c1}$ to $R_{cn}$ are selectively and electrically energized by a first driver circuit 31C in accordance with a single-line of cyan image-pixel signals, and the electrically-energized elements are heated to the temperature $T_1$ (85° C.).

Also, the line thermal head 30M includes a plurality of heater elements or electric resistance elements $R_{m1}$ to $R_{mn}$, and these resistance elements are aligned with each other along a length of the line thermal head 30M. The electric resistance elements $R_{m1}$ to $R_{mn}$ are selectively and electrically energized by a second driver circuit 31M in accordance with a single-line of magenta image-pixel signals, and the electrically-energized elements are heated to the temperature $T_2$ (135° C).

Note, in the color printer shown in FIG. 9, the line thermal heads 30C, 30M and 30Y are arranged in sequence so that the respective heating temperatures increase in the movement direction of the modified image-forming sheet 10.

Further, the line thermal head 30Y includes a plurality of heater elements or electric resistance elements $R_{y1}$ to $R_{yn}$, and these resistance elements are aligned with each other along a length of the line thermal head 30Y. The electric resistance elements $R_{y1}$ to $R_{yn}$ are selectively and electrically energized by a third driver circuit 31M in accordance with a single-line of yellow image-pixel signals, and the electrically-energized elements are heated to the temperature $T_3$ (160° C.).

The color printer further comprises a first roller platen 32C, a second roller platen 32M and a third roller platen 32Y associated with the first, second and third thermal heads 30C, 30M and 30Y, respectively, and each of the roller platens 32C, 32M and 32Y may be formed of a suitable hard rubber material. The first roller platen 32C is provided with a first spring-biasing unit 34C so as to be elastically pressed against the first thermal head 30C at the breaking-pressure $P_3$ (3.0 MPa); the second roller platen 32M is provided with a second spring-biasing unit 34M so as to be elastically pressed against the third thermal head 30Y at the breaking-pressure $P_2$ (1.0 MPa); and the third roller platen 32Y is provided with a third spring-biasing unit 34Y so as to be elastically pressed against the second thermal head 30M at the breaking-pressure $P_1$ (0.1 MPa).

Note, the roller platens 32C, 32M and 32Y are arranged in sequence so that the respective pressures, exerted by the roller platens 32C, 32M and 32Y, decrease in the movement direction of the image-forming sheet 10.

In FIG. 9, reference 36 indicates a control circuit board for controlling a printing operation of the color printer, and reference 38 indicates an electrical main power source for electrically energizing the control circuit board 36.

During a printing operation, the respective roller platens 32C, 32M and 32Y are rotated in a counterclockwise direction (FIG. 9) by three motors (not shown), respectively, with a same peripheral speed under control of the control circuit board 36. Accordingly, the image-forming sheet 10, introduced through the entrance opening 22, moves toward the exit opening 24 along the path 26. Thus, the image-forming sheet 10 is subjected to the breaking-pressure $P_3$ (3.0 MPa) when passing between the first line thermal head 30C and the first roller platen 34C; the image-forming sheet 10 is subjected to the breaking-pressure $P_2$ (1.0 MPa) when passing between the second line thermal head 30M and the second roller platen 34M; and the image-forming sheet 10 is subjected to the critical breaking-pressure $P_1$ (0.1 MPa) when passing between the third line thermal head 30Y and the third roller platen 34Y.

While the image-forming sheet 10 passes between the first line thermal head 30C and the first roller platen 34C, the selective energization of the electric resistance elements $R_{c1}$ to $R_{cn}$ are performed in accordance with a single-line of cyan image-pixel signals under control of the control circuit board 36, and the electrically-energized elements are heated to the temperature $T_1$ (85° C.), resulting in the production of a cyan dot on the image-forming sheet 10 due to the breakage of only cyan microcapsules 18C, which are locally heated by an electrically-energized resistance element.

Similarly, while the image-forming sheet 10 passes between the second line thermal head 30M and the second roller platen 34M, the selective energization of the electric resistance elements $R_{m1}$ to $R_{mn}$ are performed in accordance with a single-line of magenta image-pixel signals under control of the control circuit board 36, and the electrically-energized elements are heated to the temperature $T_2$ (135° C.), resulting in the production of a magenta dot on the image-forming sheet 10 due to the breakage of only magenta microcapsules 18M, which are locally heated by an electrically-energized resistance element.

Further, while the image-forming sheet 10 passes between the third line thermal head 30Y and the third roller platen 34Y, the selective energization of the electric resistance elements $R_{y1}$ to $R_{yn}$ are performed in accordance with a single-line of yellow image-pixel signals under control of the control circuit board 36, and the electrically-energized elements are heated to the temperature $T_3$ (160° C.), resulting in the production of a yellow dot on the image-forming sheet 10 due to the breakage of only yellow microcapsules 18Y, which are locally heated by an electrically-energized resistance element.

Note, the cyan, magenta and yellow dots, produced by the heated resistance elements $R_{cn}$, $R_{mn}$ and $R_{yn}$, have a dot size (diameter) of about 50μ to about 100μ, and thus three types of cyan, magenta and yellow microcapsules 18C, 18M and 18Y are uniformly distributed within a dot area to be produced on the image-forming sheet 10.

Of course, a color image is formed on the image-forming sheet 10 on the basis of a plurality of overlaying three-primary color dots obtained by selectively heating the electric resistance elements ($R_{c1}$ to $R_{cn}$; $R_{m1}$ to $R_{mn}$; and $R_{y1}$ to $R_{yn}$) in accordance with three-primary color digital image-pixel signals. Namely, a certain dot of the color image, formed on the image-forming sheet 10, is obtained by a combination of overlaying cyan, magenta and yellow dots produced by corresponding electric resistance elements $R_{cn}$, $R_{mn}$ and $R_{yn}$.

Figure 11:
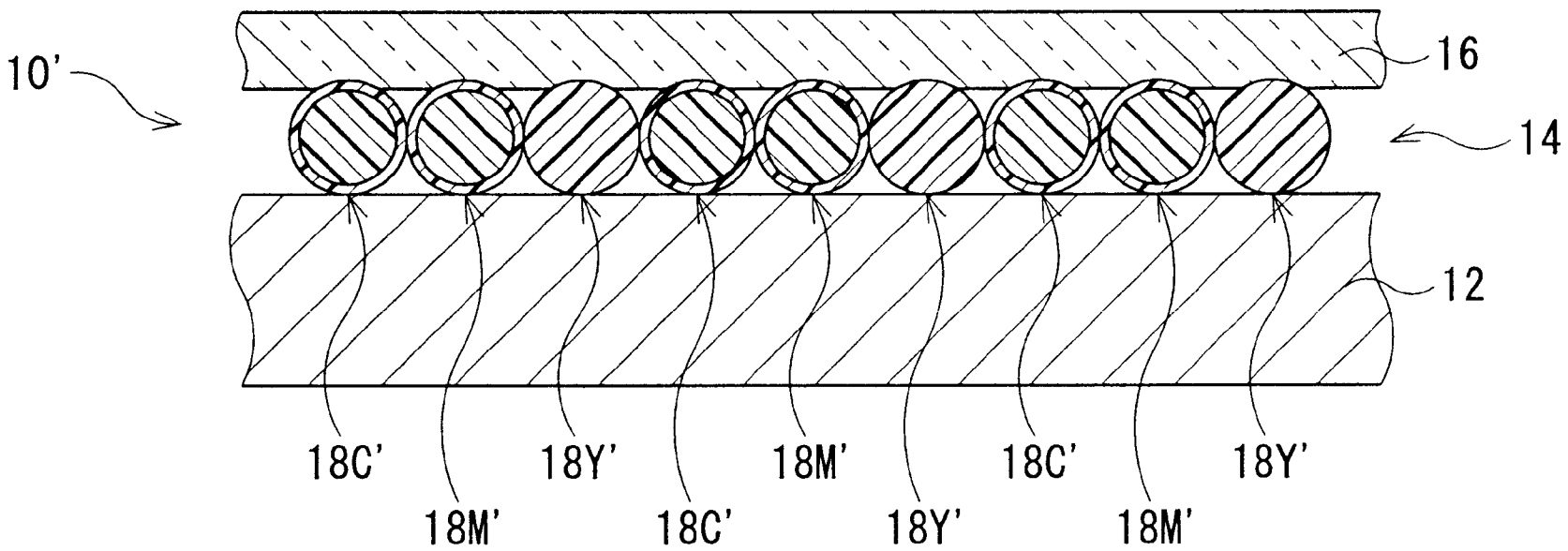
FIG. 11 is a schematic conceptual cross sectional view similar to FIG. 1, showing a modification of the first embodiment of the image-forming substrate, according to the present invention, comprising a layer of microcapsules including a first type of microcapsule filled with a solid cyan-ink, a second type of microcapsule filled with a solid magenta ink and solid yellow-ink particles.

FIG. 11 shows a modification of the image-forming sheet 10, generally indicated by reference 10'. Note, in FIG. 11, the features similar to those of FIG. 1 are indicated by the same reference numerals. As is apparent from FIG. 11, in the modified image-forming sheet 10', a layer of microcapsules 14 is formed from two types of microcapsules 18C' and 18M' and solid yellow-ink particles 18Y'.

The first type of microcapsule 18C' is filled with a solid cyan-ink which is identical to that of the first type of microcapsule 18C shown in FIG. 1, and thus the solid cyan-ink exhibits the melting point of about 83° C. Also, the second type of microcapsule 18M' is filled with a solid magenta-ink which is identical to that of the second type of microcapsule 18M shown in FIG. 1, and thus the solid magenta-ink exhibits the melting point of about 125° C. Each of the solid yellow-ink particles 18Y' is composed of benzine yellow G, as a yellow pigment, and styrene-methylmethacrylate copolymer, as a vehicle, exhibiting a melting point of about 200° C. An outer surface of each solid yellow-ink particle 18Y' is usually colored white because, in general, a sheet of paper 12 exhibits white. Of course, if the sheet of paper 12 is colored with a single color pigment, the outer surface of each solid yellow-ink particle 18Y' may be colored by the same single color pigment.

In the modified image-forming sheet 10', a shell thickness of the first type microcapsule 18C' is selected such that each cyan microcapsule 18C' is squashed and broken under a pressure more than a predetermined critical pressure of 0.2 MPa when each cyan microcapsule 18C' is heated to a temperature between the melting point (about 83° C.) of the solid cyan-ink and the melting point (about 125° C.) of the magenta solid-ink. Also, a shell thickness of the second type microcapsule 18M' is selected such that each magenta microcapsule 18M' is squashed and broken under a pressure that lies between a predetermined critical pressure of 0.02 MPa and the predetermined critical pressure of 0.2 MPa when each magenta microcapsule 18M' is heated to a temperature between the melting point (about 125° C.) of the solid magenta-ink and the melting point (about 200° C.) of the solid yellow-ink particle 18Y'. Note, the shell thickness of the first type of microcapsule 18C' is thicker than that of the second type of microcapsule 18M'. Of course, each of the solid yellow-ink particles 18Y' is thermally broken and melted, without being subjected to a substantial pressure, when being heated to a temperature more than the melting point (about 200° C.) thereof.

Figure 12:
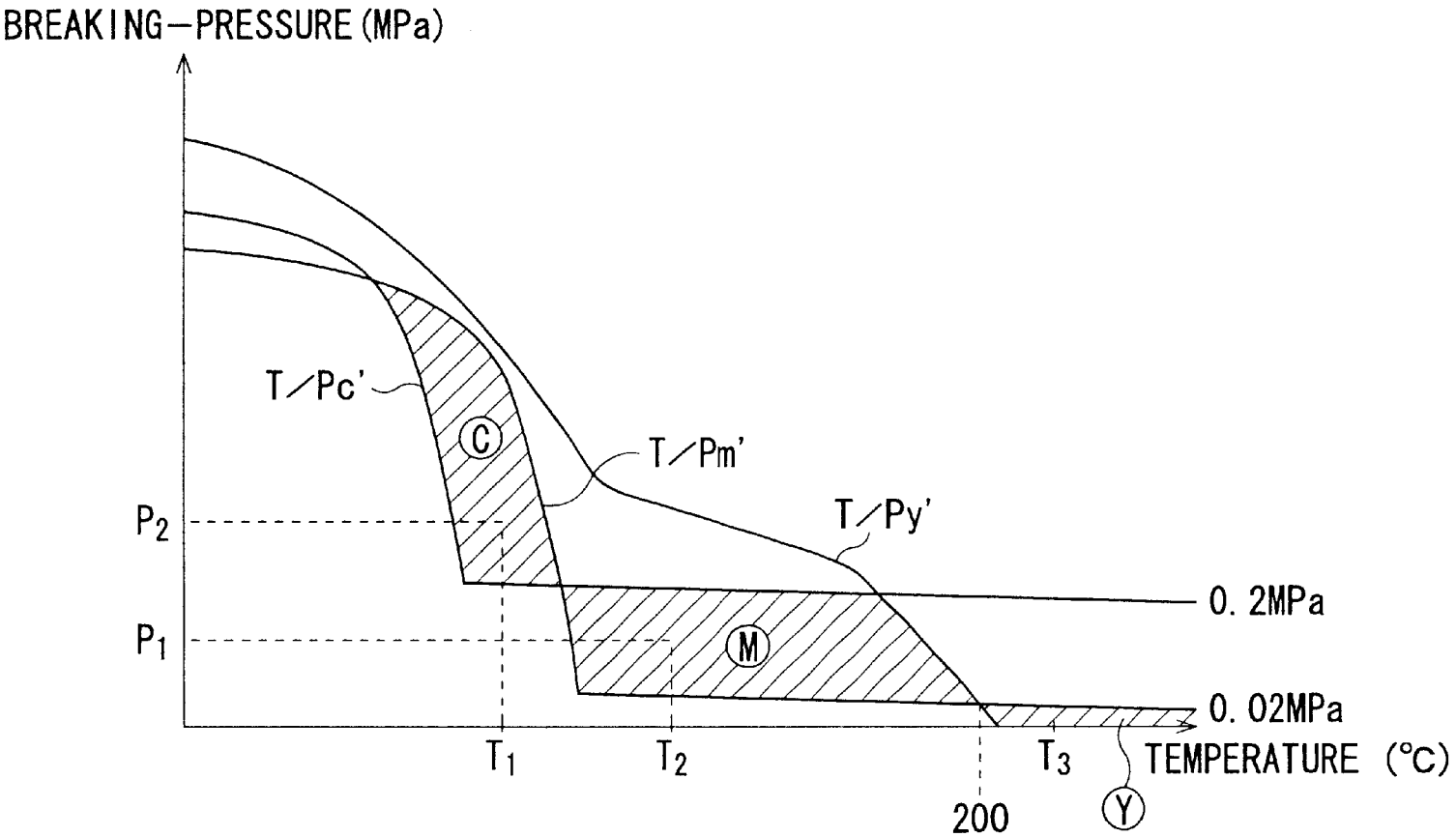
FIG. 12 is a graph showing temperature/pressure breaking characteristics of the first and second types of microcapsules and the solid yellow-ink particles shown in FIG. 11, with each of a cyan-developing zone, a magenta-developing zone and a yellow-developing zone being indicated as a hatched zone.

Thus, as shown in FIG. 12, it is possible to obtain a temperature/pressure breaking characteristic $T/P_c'$ of the first type of microcapsule 18C', a temperature/pressure breaking characteristic $T/P_m'$ of the second type of micro-capsule 18M' and a temperature/pressure breaking characteristic $T/P_y'$ of the solid yellow-ink particles 18Y', and a hatched cyan-developing zone C, a hatched magenta-developing zone M and a hatched yellow-developing zone Y are defined by the characteristics $T/P_c'$, $T/P_m'$ and $T/P_y'$. Accordingly, similar to the first embodiment, by suitably selecting a heating temperature and a breaking pressure, which should be locally exerted on the image-forming sheet 10', it is possible to selectively squash and break the first and second types of microcapsules 18C' and 18M' and the solid yellow-ink particles 18Y' at the localized area of the image-forming sheet 10' on which the heating temperature and the breaking pressure are exerted.

In particular, as shown in FIG. 12, for example, if a heating temperature $T_1$ and a breaking pressure $P_2$, which should be locally exerted on the image-forming sheet 10', are selected so as to fall within the hatched cyan-developing zone C, only the cyan microcapsules 18C' are squashed and broken at the localized area of the image-forming sheet 10' on which the heating temperature $T_1$ and the breaking pressure $P_2$ are exerted, resulting in discharge of the molten cyan-ink from the squashed and broken microcapsules 18C'.

Also, as shown in FIG. 12, if a heating temperature $T_2$ and a breaking pressure $P_1$, which should be locally exerted on the image-forming sheet 10', are selected so as to fall within the hatched magenta-developing zone M, only the magenta microcapsules 18M' are squashed and broken at the localized area of the image-forming sheet 10' on which the heating temperature $T_2$ and the breaking pressure $P_1$ are exerted, resulting in discharge of the molten magenta-ink from the squashed and broken microcapsules 18M'.

Further, as shown in FIG. 12, if a heating temperature $T_3$ and a small pressure (substantially less than the critical breaking pressure of 0.02 MPa), which should be locally exerted on the image-forming sheet 10', is selected so as to fall within the hatched yellow-developing zone Y, only the solid yellow-ink particles 18Y' are thermally broken and molten at the localized area of the image-forming sheet 10' on which the heating temperature $T_3$ and the small pressure are exerted, resulting in development of the molten yellow-ink particles 18M'.

Accordingly, if the selection of a heating temperature and a breaking pressure, which should be locally exerted on the image-forming sheet 10', are suitably controlled in accordance with digital color image-pixel signals: digital cyan image-pixel signals, digital magenta image-pixel signals and digital yellow image-pixel signals, it is possible to form a color image on the image-forming sheet 10' on the basis of the digital color image-pixel signals.

Note, in the image-forming sheet 10', the heating temperatures $T_1$, $T_2$ and $T_3$ may be 85° C., 135° C. and 205° C., respectively, and the breaking pressures $P_1$ and $P_2$ may be 0.1 MPa and 1.0 MPa, respectively.

Similar to the first embodiment, with using a color line printer as shown in FIG. 9, it is possible to form a color image on the image-forming sheet 10' in accordance with three-primary color digital image-pixel signals, in substantially the same manner as mentioned above. Of course, in the modified embodiment, before a color image can be formed on the image-forming sheet 10', a first spring-biasing unit 34C should be arranged such that a first roller platen 32C is elastically pressed against a first thermal head 30C at the breaking-pressure $P_2$ (1.0 MPa); a second spring-biasing unit 34M should be arranged such that a second roller platen 32M is elastically pressed against a second thermal head 30M at the breaking-pressure $P_1$ (0.1 MPa); a third spring-biasing unit 34Y should be arranged such that a third roller platen 32Y is elastically pressed against a third thermal head 30Y at the small pressure substantially less than the critical breaking pressure of 0.02 MPa; and electric resistance elements $R_{y1}$ to $R_{yn}$ of the third thermal head 30Y should be selectively and electrically energized such that the selectively-energized elements are heated to the temperature $T_3$ (205° C.).

Figure 13:
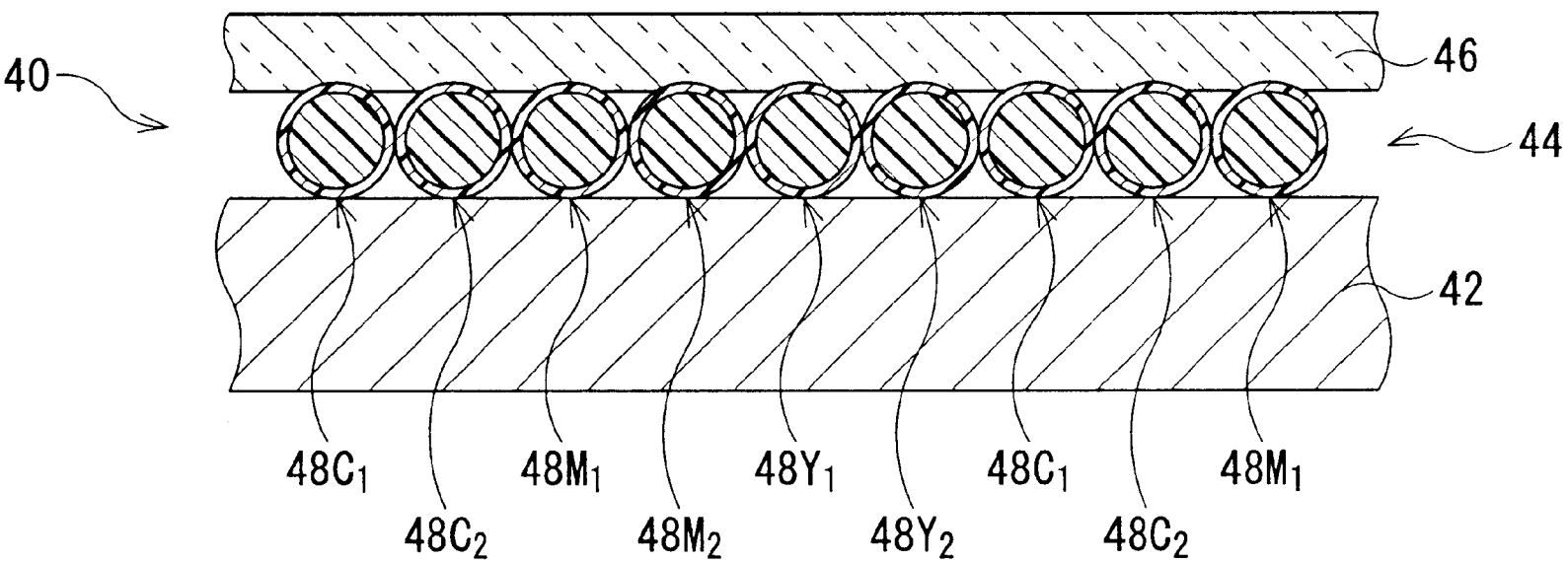
FIG. 13 is a schematic conceptual cross sectional view showing a second embodiment of an image-forming substrate, according to the present invention, comprising a layer of microcapsules including a first type of microcapsule filled with a first solid cyan-ink, a second type of microcapsule filled with a second solid cyan-ink, a third type of microcapsule filled with a first solid magenta-ink, a fourth type of microcapsule filled with a second solid magenta-ink, a fifth type of microcapsule filled with a first solid yellow-ink, and a sixth type of microcapsule filled with a second solid yellow-ink.

FIG. 13 shows a second embodiment of an image-forming substrate, generally indicated by reference 40, which is also produced in a form of paper sheet. In particular, similar to the first embodiment, the image-forming sheet 40 comprises a sheet of paper 42, a layer of microcapsules 44 coated over a surface of the sheet of paper 42, and a sheet of protective transparent film or ultraviolet barrier film 46 covering the layer of microcapsules 44. The microcapsule layer 44 is formed of a plurality of microcapsules comprising six types of microcapsules $48C_1$, $48C_2$, $48M_1$, $48M_2$, $48Y_1$ and $48Y_2$ uniformly distributed over the surface of the paper sheet 42.

Figure 14:
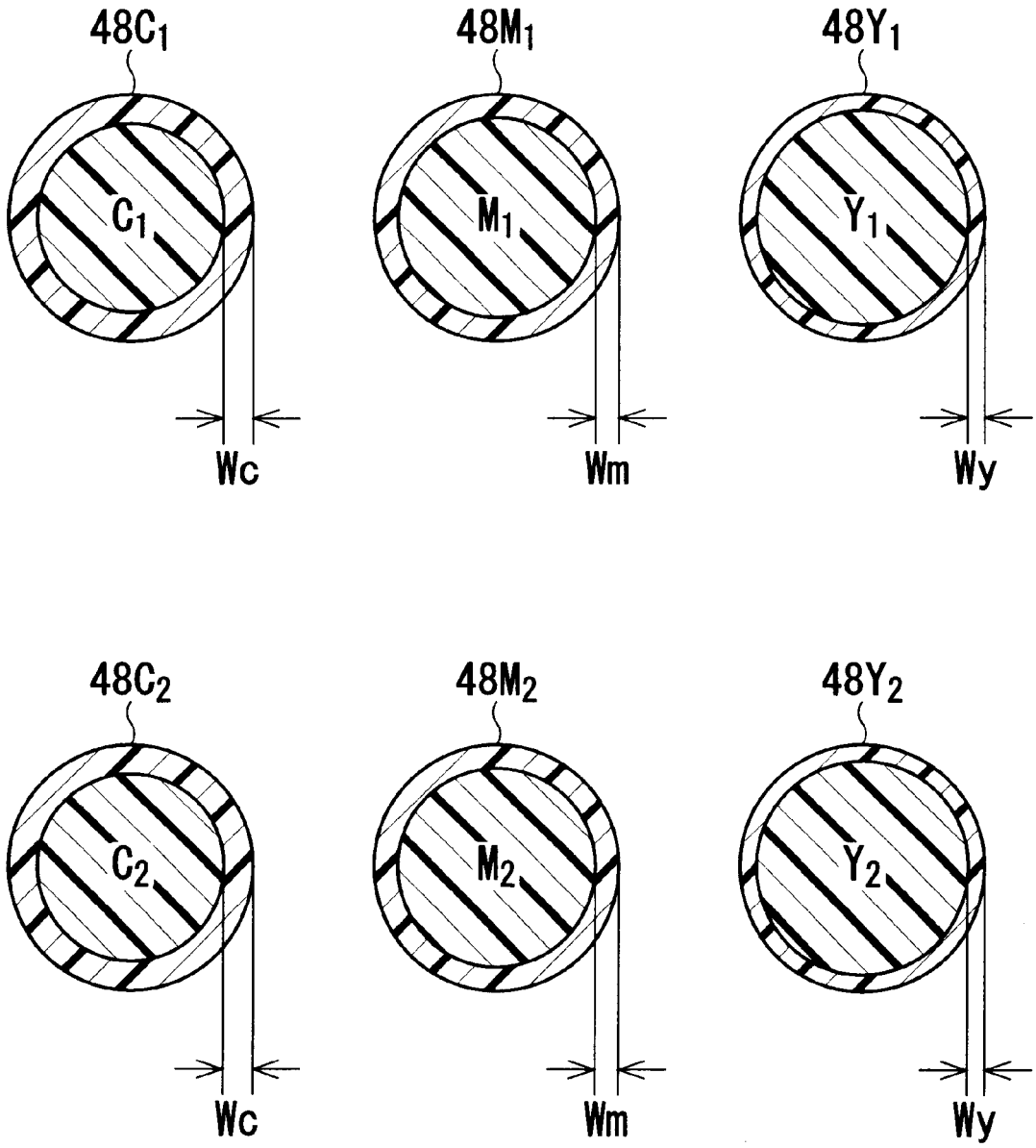
FIG. 14 is a schematic cross sectional view showing different shell thicknesses of the first, second, third, fourth, fifth and sixth types of microcapsules shown in FIG. 13.

As shown in FIG. 14, the first type of microcapsule $48C_1$ is filled with a first solid cyan-ink $C_1$; a second type of microcapsule $48C_2$ is filled with a second solid cyan-ink $C_2$; a third type of microcapsule $48M_1$ is filled with a first solid magenta-ink $M_1$; a fourth type of microcapsule $48M_2$ is filled with a second solid magenta-ink $M_2$; a fifth type of microcapsule $48Y_1$ is filled with a first solid yellow-ink $Y_1$; and a sixth type of microcapsule $48Y_2$ is filled with a second solid yellow-ink $Y_2$. The first and second solid cyan-inks $C_1$ and $C_2$ may exhibit the same cyan density or may exhibit different cyan densities; the first and second solid magenta-inks inks $M_1$ and $M_2$ may exhibit the same magenta density or may exhibit different magenta densities; and the first and second solid yellow-inks $Y_1$ and $Y_2$ may exhibit the same yellow density or may exhibit different yellow densities.

Note, similar to the first embodiment, each type of microcapsule ($48C_1$, $48C_2$, $48M_1$, $48M_2$, $48Y_1$, $48Y_2$) may have an average diameter of several microns, for example, 5$\mu$ to 10$\mu$. Also, note, it is possible to perform the uniform formation of the microcapsule layer 44 in the same manner as mentioned above in the description of the first embodiment. Further, note, usually, in each type of microcapsule ($48C_1$, $48C_2$, $48M_1$, $48M_2$, $48Y_1$, $48Y_2$), a shell of a microcapsule is colored white for the same reasons as mentioned above in the description of the first embodiment.

In the second embodiment, the first solid cyan-ink $C_1$, encapsulated in the first type of microcapsule $48C_1$, is composed of paraffin wax, as a vehicle, and phthalocyanine blue, as a cyan pigment. As shown in a graph of FIG. 15, this paraffin wax, and therefore the first solid cyan-ink $C_1$, exhibits a characteristic curve of a coefficient of elasticity, indicated by reference $EC_1$, with respect to a variation in temperature. Namely, this paraffin-wax-type cyan-ink $C_1$ is thermally plasticized at a temperature of about from 52° C. to about 55° C., and is completely and thermally melted at a temperature of about 60° C. Note, the paraffin wax, exhibiting the melting point of about 60° C., is, for example, available as HNP-5 from NIHON SEIRO K.K.

Figure 15:
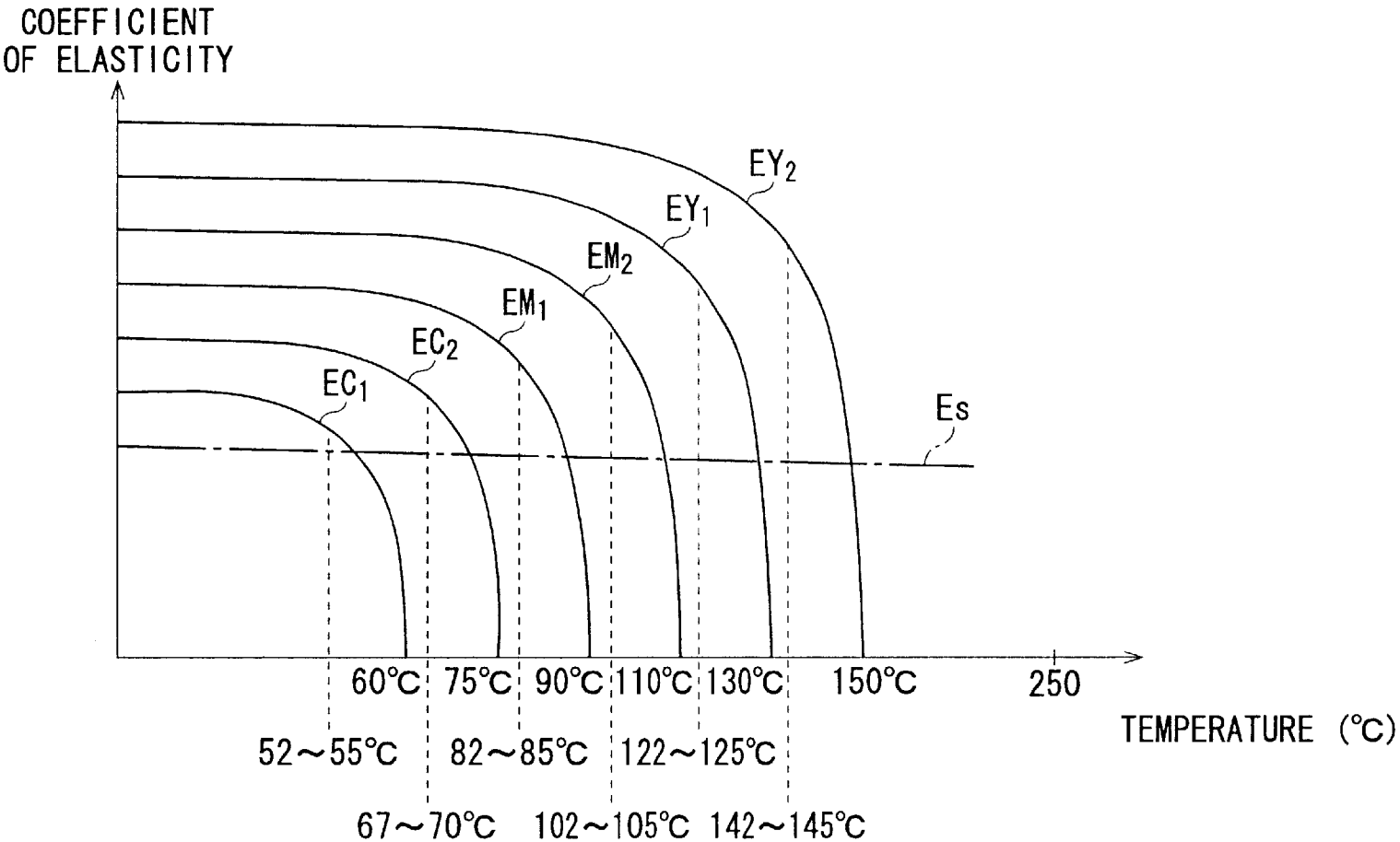
FIG. 15 is a graph showing characteristic curves of longitudinal elasticity coefficients of the first solid cyan-ink, second cyan-ink, first solid magenta-ink, second solid magenta-ink, first solid yellow-ink, and second solid yellow-ink of the first, second, third, fourth, fifth and sixth types of microcapsules shown in FIG. 13.

Similarly, the second solid cyan-ink $C_2$, encapsulated in the second type of microcapsule $48C_2$, is composed of paraffin wax, as a vehicle, and phthalocyanine blue, as a cyan pigment. As shown in the graph of FIG. 15, this paraffin wax, and therefore the second solid cyan-ink $C_2$, exhibits a characteristic curve of a coefficient of elasticity, indicated by reference $EC_2$, with respect to a variation in temperature. Namely, this paraffin-wax-type cyan-ink $C_2$ is thermally plasticized at a temperature of from about 67° C. to about 70° C., and is completely and thermally melted at a temperature of about 75° C. Note, the paraffin wax, exhibiting the melting point of about 75° C., is, for example, available as HNP-3 from NIHON SEIRO K.K.

Also, the first solid magenta-ink $M_1$, encapsulated in the third type of microcapsule $48M_1$, is composed of microcrystalline wax, as a vehicle, and rhodamine lake T, as a magenta pigment. As shown in the graph of FIG. 15, this microcrystalline wax, and therefore the first solid magenta-ink $M_1$, exhibits a characteristic curve of a coefficient of elasticity, indicated by reference $EM_1$, with respect to a variation in temperature. Namely, this microcrystalline-wax-type magenta-ink $M_1$ is thermally plasticized at a temperature of from about 82° C. to about 85° C., and is completely and thermally melted at a temperature of about 90° C. Note, the microcrystalline wax, exhibiting the melting point of about 90° C., is, for example, available as Hi-Mic-3090 from NIHON SEIRO K.K.

Similarly, the second solid magenta-ink $M_2$, encapsulated in the fourth type of microcapsule $48M_2$, is composed of microcrystalline wax, as a vehicle, and rhodamine lake T, as a magenta pigment. As shown in the graph of FIG. 15, this microcrystalline wax, and therefore the second solid magenta-ink $M_2$ exhibits a characteristic curve of a coefficient of elasticity, indicated by reference $EM_2$, with respect to a variation in temperature. Namely, this microcrystalline-wax-type magenta-ink $M_2$ is thermally plasticized at a temperature of from about 102° C. to about 105° C., and is completely and thermally melted at a temperature of about 110° C. Note, the microcrystalline wax, exhibiting the melting point of about 110° C., is, for example, available as CWP-3 from SEISHIN KIGYO K.K.

Further, the first solid yellow-ink $Y_1$, encapsulated in the fifth type of microcapsule $48Y_1$, is composed of olefin wax, as a vehicle, and benzine yellow G, as a yellow pigment. As shown in the graph of FIG. 15, this olefin wax, and therefore the first solid yellow-ink $Y_1$, exhibits a characteristic curve of a coefficient of elasticity, indicated by reference $EY_1$, with respect to a variation in temperature. Namely, this olefin-wax-type yellow-ink $Y_1$ is thermally plasticized at a temperature of from about 122° C. to about 125° C., and is completely and thermally melted at a temperature of about 130° C.

Similarly, the second solid yellow-ink $Y_2$, encapsulated in the sixth type of microcapsule $48Y_2$, is composed of polypropylene wax, as a vehicle, and benzine yellow G, as a yellow pigment. As shown in the graph of FIG. 15, this polypropylene wax, and therefore the second solid yellow-ink $Y_2$ exhibits a characteristic curve of a coefficient of elasticity, indicated by reference $EY_2$, with respect to a variation in temperature. Namely, this polypropylene-wax-type yellow-ink $Y_2$ is thermally plasticized at a temperature of from about 142° C. to about 145° C., and is completely and thermally melted at a temperature of about 150° C. Note, the polypropylene wax, exhibiting the melting point of about 150° C., is, for example, available as PP-5 from SEISHIN KIGYO K.K.

On the other hand, similar to the first embodiment, a shell of each type of microcapsule ($48C_1$, $48C_2$, $48M_1$, $48M_2$, $48Y_1$, $48Y_2$) is formed of melamine resin. As already stated, a coefficient of elasticity of the melamine resin, indicated by reference $E_s$ in the graph of FIG. 15, is substantially constant with respect to a variation in temperature over a range between 0° C. and 250° C.

In the second embodiment, although the shells of the six types of microcapsules 48$C_1$, 48$C_2$, 48$M_1$, 48$M_2$, 48$Y_1$ and 48$Y_2$ are formed of the melamine resin, the shells of the first and second types of microcapsules 48$C_1$ and 48$C_2$, the shells of the third and fourth types of microcapsules 48$M_1$ and 48$M_2$, and the shells of the fifth and sixth types of microcapsules 48$Y_1$ and 48$Y_2$ have differing shell thicknesses $W_c$, $W_m$ and $W_y$, respectively, as shown in FIG. 14. The shell thickness $W_c$ of the first and second types of microcapsules 48$C_1$ and 48$C_2$ is thicker than the shell thickness $W_y$ of the third and fourth types of microcapsules 48$M_1$ and 48$M_2$, which is thicker than the shell thickness $W_y$ of the fifth and sixth types of microcapsules 48$Y_1$ and 48$Y_2$.

Similar to the first embodiment, each type of microcapsules (48$C_1$, 48$C_2$, 48$M_1$, 48$M_2$, 48$Y_1$, 48$Y_2$) can endure a considerably high pressure without being squashed and broken as long as a corresponding solid ink, encapsulated therein, exhibits a solid-phase under a normal ambient temperature. Nevertheless, each microcapsule (48$C_1$, 48$C_2$, 48$M_1$, 48$M_2$, 48$Y_1$, 48$Y_2$) is easily squashed and broken by a relatively low pressure when the corresponding solid ink is heated so as to be thermally melted, i.e., when the solid phase of the solid ink is changed into a liquid phase.

According to the second embodiment, the shell thickness $W_c$ of the first and second types of microcapsules 48$C_1$ and 48$C_2$ is selected such that each cyan microcapsule (48$C_1$, 48$C_2$) is squashed and broken under a pressure more than a predetermined critical pressure of 2.0 MPa when each cyan microcapsule (48$C_1$, 48$C_2$) is heated to a temperature more than a melting point (about 60° C. or about 75° C.) of a corresponding solid cyan-ink ($C_1$ or $C_2$). In particular, when the first type of microcapsule 48$C_1$ is heated to a temperature between the melting point (about 60° C.) of the first solid cyan-ink $C_1$ and the melting point (about 75° C.) of the second solid cyan-ink $C_2$ so that the first solid cyan-ink $C_1$, encapsulated therein, is thermally melted, it is possible to perform the breakage of the first type of microcapsule 48$C_1$ under a pressure more than a predetermined critical pressure of 2.0 MPa, and, when the second type of microcapsule 48$C_2$ is heated to a temperature between the melting point (about 75° C.) of the second solid cyan-ink $C_2$ and the melting point (about 90° C.) of the first solid magenta-ink $M_1$ so that the second solid cyan-ink $C_2$, encapsulated therein, is thermally melted, it is possible to perform the breakage of the second type of microcapsule 48$C_2$ under a pressure more than the predetermined critical pressure of 2.0 MPa.

Also, the shell thickness $W_m$ of the third and fourth types of microcapsules 48$M_1$ and 48$M_2$ is selected such that each magenta microcapsule (48$M_1$, 48$M_2$) is squashed and broken under a pressure that lies between a predetermined critical pressure of 0.2 MPa and the predetermined critical pressure of 2.0 MPa when each magenta microcapsule (48$M_1$, 48$M_2$) is heated to a temperature more than a melting point (about 90° C. or about 110° C.) of a corresponding solid magenta-ink ($M_1$ or $M_2$). In particular, when the third type of microcapsule 48$M_1$ is heated to a temperature between the melting point (about 90° C.) of the first solid magenta-ink $M_1$ and the melting point (about 110° C.) of the second solid magenta-ink $M_2$ so that the first solid magenta-ink $M_1$, encapsulated therein, is thermally melted, it is possible to perform the breakage of the third type of microcapsule 48$M_1$ under a pressure that lies between the predetermined critical pressure of 0.2 MPa and the predetermined critical pressure of 2.0 MPa, and, when the fourth type of microcapsule 48$M_2$ is heated to a temperature between the melting point (about 110° C.) of the second solid magenta-ink $M_2$ and the melting point (about 130° C.) of the first solid yellow-ink $Y_1$ so that the second solid magenta-ink $M_2$, encapsulated therein, is thermally melted, it is possible to perform the breakage of the fourth type of microcapsule 48$M_2$ under a pressure that lies between the predetermined critical pressure of 0.2 MPa and the predetermined critical pressure of 2.0 MPa.

Further, the shell thickness $W_y$ of the fifth and sixth types of microcapsules 48$Y_1$ and 48$Y_2$ is selected such that each yellow microcapsule (48$Y_1$, 48$Y_2$) is squashed and broken under a pressure that lies between a predetermined critical pressure of 0.02 MPa and the predetermined critical pressure of 0.2 MPa when each yellow microcapsule (48$Y_1$, 48$Y_2$) is heated to a temperature more than a melting point (about 130° C. or about 150° C.) of a corresponding solid yellow-ink ($Y_1$ or $Y_2$). In particular, when the fifth type of microcapsule 48$Y_1$ is heated to a temperature between the melting point (about 130° C.) of the first solid yellow-ink $Y_1$ and the melting point (about 150° C.) of the second solid yellow-ink $Y_2$ so that the first solid yellow-ink $Y_1$, encapsulated therein, is thermally melted, it is possible to perform the breakage of the fifth type of microcapsule 48$Y_1$ under a pressure that lies between the predetermined critical pressure of 0.02 MPa and the predetermined critical pressure of 0.2 MPa, and, when the sixth type of microcapsule 48$Y_2$ is heated to a temperature more than the melting point (about 150° C.) of the second solid yellow-ink $Y_2$ so that the second solid yellow-ink $Y_2$, encapsulated therein, is thermally melted, it is possible to perform the breakage of the sixth type of microcapsule 48$Y_2$ under a pressure that lies between the predetermined critical pressure of 0.02 MPa and the predetermined critical pressure of 0.2 MPa.

Figure 16:
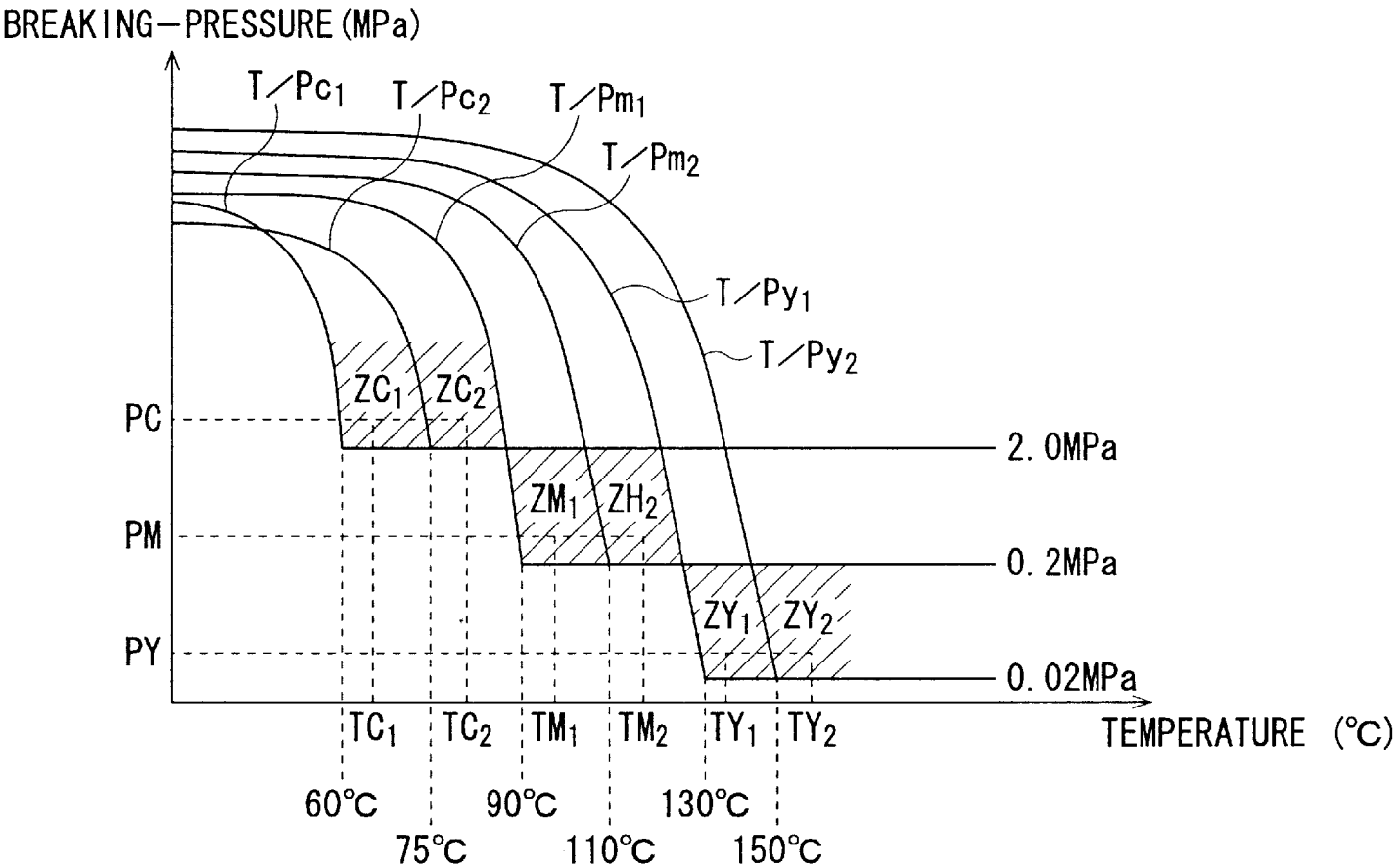
FIG. 16 is a graph showing temperature/pressure breaking characteristics of the first, second, third, fourth, fifth and sixth types of microcapsules shown in FIG. 13, with each of a first cyan-developing zone, a second cyan-developing zone, a first magenta-developing zone, a second magenta-developing zone, a first yellow-developing zone and a second yellow-developing zone being indicated as a hatched zone.

Thus, as shown in a graph of FIG. 16, it is possible to obtain a temperature/pressure breaking characteristic $T/P_{c1}$ of the first type of microcapsule 48$C_1$, a temperature/pressure breaking characteristic $T/P_{c2}$ of the second type of micro-capsule 48$C_2$, a temperature/pressure breaking characteristic $T/P_{m1}$ of the third type of microcapsule 48$M_1$, a temperature/pressure breaking characteristic $T/P_{m2}$ of the fourth type of microcapsule 48$M_2$, a temperature/pressure breaking characteristic $T/P_{y1}$ of the fifth type of microcapsule 48$Y_1$, a temperature/pressure breaking characteristic $T/P_{y2}$ of the sixth type of microcapsule 48$Y_2$; and these characteristics $T/P_{c1}$, $T/P_{c2}$, $T/P_{m1}$, $T/P_{m2}$, $T/P_{y1}$ and $T/P_{y2}$ define a first hatched cyan-developing zone $ZC_1$, a second hatched cyan-developing zone $ZC_2$, a first hatched magenta-developing zone $ZM_1$, a second magenta-developing zone $ZM_2$, a first hatched yellow-developing zone $ZY_1$ and a second hatched yellow-developing zone $ZY_2$. Accordingly, by suitably selecting a heating temperature and a breaking pressure, which should be locally exerted on the image-forming sheet 40, it is possible to selectively squash and break the first, second, third, fourth, fifth and sixth types of microcapsules 48$C_1$, 48$C_2$, 48$M_1$, 48$M_2$, 48$Y_1$ and 48$Y_2$ at the localized area of the image-forming sheet 40 on which the heating temperature and the breaking pressure are exerted.

For example, as shown in FIG. 16, if a heating temperature $TC_1$ and a breaking pressure PC, which should be locally exerted on the image-forming sheet 40, are selected so as to fall within the first hatched cyan-developing zone $ZC_1$, only the first type of microcapsule 48$C_1$ is squashed and broken at the localized area of the image-forming sheet 40 on which the heating temperature $TC_1$ and the breaking pressure PC are exerted, resulting in discharge of the molten cyan-ink $C_1$ from the squashed and broken microcapsules 48$C_1$. If a heating temperature $TC_2$ and the breaking pressure PC, which should be locally exerted on the image-forming sheet 40, are selected so as to fall within the second hatched cyan-developing zone $ZC_2$, both the first and second types of microcapsules 48$C_1$ and 48$C_2$ are squashed and broken at the localized area of the image-forming sheet 40 on which the heating temperature $TC_2$ and the breaking pressure PC are exerted, resulting in discharge of the molten cyan-inks $C_1$ and $C_2$ from the squashed and broken microcapsules 48$C_1$ and 48$C_2$.

Also, as shown in FIG. 16, if a heating temperature $TM_1$ and a breaking pressure PM, which should be locally exerted on the image-forming sheet 40, are selected so as to fall within the first hatched magenta-developing zone $ZM_1$, only the third type of microcapsule 48$M_1$ is squashed and broken at the localized area of the image-forming sheet 40 on which the heating temperature $TM_1$ and the breaking pressure PM are exerted, resulting in discharge of the molten magenta-ink $M_1$ from the squashed and broken microcapsules 48$M_1$. If a heating temperature $TM_2$ and the breaking pressure PM, which should be locally exerted on the image-forming sheet 40, are selected so as to fall within the second hatched magenta-developing zone $ZM_2$, both the third and fourth types of microcapsules 48$M_1$ and 48$M_2$ are squashed and broken at the localized area of the image-forming sheet 40 on which the heating temperature $TM_2$ and the breaking pressure PM are exerted, resulting in discharge of the molten magenta-inks $M_1$ and $M_2$ from the squashed and broken microcapsules 48$M_1$ and 48$M_2$.

Further, as shown in FIG. 16, if a heating temperature $TY_1$ and a breaking pressure PY, which should be locally exerted on the image-forming sheet 40, are selected so as to fall within the first hatched yellow-developing zone $ZY_1$, only the fifth type of microcapsule 48$Y_1$ is squashed and broken at the localized area of the image-forming sheet 40 on which the heating temperature $TY_1$ and the breaking pressure PY are exerted, resulting in discharge of the molten yellow-ink $Y_1$ from the squashed and broken microcapsules 48$Y_1$. If a heating temperature $TY_2$ and the breaking pressure PY, which should be locally exerted on the image-forming sheet 40, are selected so as to fall within the second hatched yellow-developing zone $ZY_2$, both the fifth and sixth types of microcapsules 48$Y_1$ and 48$Y_2$ are squashed and broken at the localized area of the image-forming sheet 40 on which the heating temperature $TY_2$ and the breaking pressure PY are exerted, resulting in discharge of the molten yellow-inks $Y_1$ and $Y_2$ from the squashed and broken microcapsules 48$Y_1$ and 48$Y_2$.

Note, in the second embodiment, the heating temperatures $TC_1$, $TC_2$, $TM_1$, $TM_2$, $TY_1$ and $TY_2$ may be 65° C., 80° C., 95° C., 115° C., 135° C. and 160° C., respectively, and the breaking pressures PC, PM and PY may be 0.1 MPa, 1.0 MPa and 3.0 MPa, respectively.

According to the second embodiment, not only can a color image be formed on the image-forming sheet 40 by producing color (yellow, magenta and cyan) image-pixel dots in accordance with digital color image-pixel signals, similar to the first embodiment, but also it is possible to obtain a variation in density (gradation) of the color image-pixel dots produced on the image-forming sheet 40. Of course, before the variation in density (gradation) of the color image-pixel dots can be obtained, each of the digital color image-pixel signals preferably carries a digital 2-bit gradation-signal.

Although a color line printer, as shown in FIG. 9, may be utilized for the formation of the color image on the image-forming sheet 40, each of first, second and third driver circuits 31C, 31M and 31Y (FIG. 10) must be operated in accordance with corresponding monochromatic color image-pixel signals carrying a digital 2-bit gradation-signal.

For example, the first driver circuit 31C selectively and electrically energizes a plurality of electric resistance elements $R_{c1}$ to $R_{cn}$ in accordance with a single-line of cyan image-pixel signals, each of which carries 2-bit gradation-signal.

In particular, when a digital cyan image-pixel signal has a value "0", and when a 2-bit gradation-signal carried thereby has a value [00], a corresponding electric resistance element ($R_{c1}$, . . . , $R_{cn}$) is not electrically energized, thereby producing no cyan dot on the image-forming sheet 40.

Figure 17:
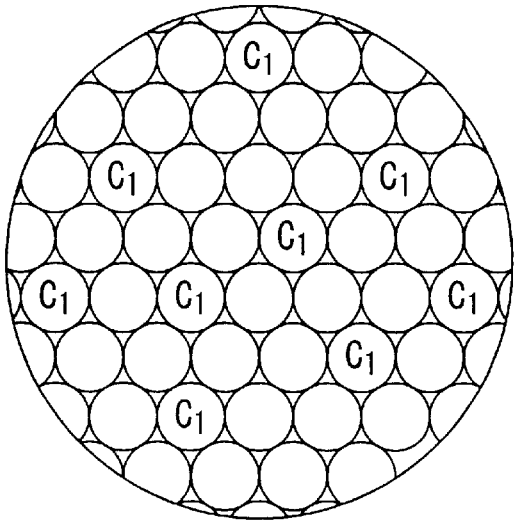
FIG. 17 is a conceptual view showing an example of variation in density (gradation) of a cyan dot produced on the image-forming substrate of FIG. 13.

If a digital cyan image-pixel signal has a value "1", and if a 2-bit digital gradation signal carried thereby has a value [01], a corresponding electric resistance element ($R_{c1}$, . . . , $R_{cn}$) is electrically energized so as to be heated to a temperature $TC_1$ (65° C.), thereby producing a cyan dot, colored y only the molten cyan-ink $C_1$, on the image-forming sheet 40. Namely, as conceptually shown in FIG. 17, in this cyan dot, only the first type of microcapsules 48$C_1$ are squashed and broken, resulting in discharge of the molten cyan-ink $C_1$ from the squashed and broken microcapsules 48$C_1$.

Figure 18:
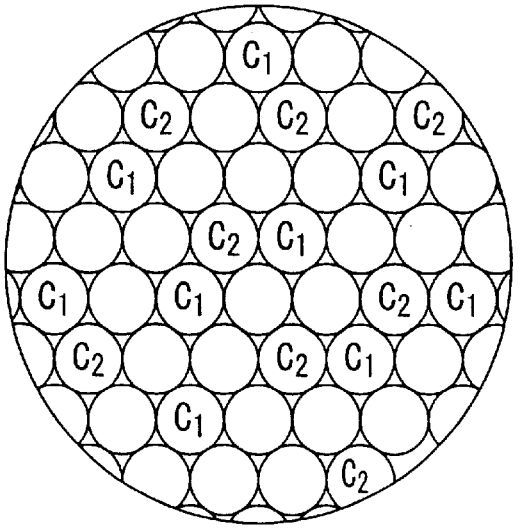
FIG. 18 is a conceptual view showing another example of variation in density (gradation) of a cyan dot produced on the image-forming substrate of FIG. 13.

If a digital cyan image-pixel signal has a value "1", and if a 2-bit digital gradation signal carried thereby has a value [10], a corresponding electric resistance element ($R_{c1}$, . . . , $R_{cn}$) is electrically energized so as to be heated to a temperature $TC_2$ (80° C.), thereby producing a cyan dot, colored by both the molten cyan-inks $C_1$ and $C_2$ on the image-forming sheet 40. Namely, as conceptually shown in FIG. 18, in this cyan dot, both the first and second types of microcapsules 48$C_1$ and 48$C_2$ are squashed and broken, resulting in discharge of the molten cyan-inks $C_1$ and $C_2$ from the squashed and broken microcapsules 48$C_1$ and 48$C_2$.

Of course, a cyan density of the cyan dot (FIG. 17), colored by only the first cyan-ink $C_1$, is different from that of the cyan dot (FIG. 18) colored by both the first and second cyan-inks $C_1$ and $C_2$, thereby obtaining a variation in density (gradation) of the cyan dot.

Similarly, the second driver circuit 31M selectively and electrically energizes a plurality of electric resistance elements $R_{m1}$ to $R_{mn}$ in accordance with a single-line of magenta image-pixel signals, each of which carries 2-bit gradation-signal.

In particular, when a digital magenta image-pixel signal has a value "0", and when a 2-bit gradation-signal carried thereby has a value [00], a corresponding electric resistance element ($R_{m1}$, . . . , $R_{mn}$) is not electrically energized, thereby producing no magenta dot on the image-forming sheet 40.

If a digital magenta image-pixel signal has a value "1", and if a 2-bit digital gradation signal carried thereby has a value [01], a corresponding electric resistance element ($R_{m1}$, . . . , $R_{mn}$) is electrically energized so as to be heated to a temperature $TM_1$, (95° C.), thereby producing a magenta dot, colored by only the molten magenta-ink $M_1$, on the image-forming sheet 40. Namely, in this magenta dot, only the third type of microcapsules 48$M_1$ are squashed and broken, resulting in discharge of the molten magenta-ink $M_1$ from the squashed and broken microcapsules 48$M_1$.

If a digital magenta image-pixel signal has a value "1", and if a 2-bit digital gradation signal carried thereby has a value [10], a corresponding electric resistance element ($R_{m1}$, . . . , $R_{mn}$) is electrically energized so as to be heated to a temperature $TM_2$ (115° C.), thereby producing a magenta dot, colored by both the molten magenta inks $M_1$ and $M_2$ on the image-forming sheet 40. Namely, in this magenta dot, both the third and fourth types of microcapsules 48$M_1$ and 48$M_2$ are squashed and broken, resulting in discharge of the molten magenta-inks $M_1$ and $M_2$ from the squashed and broken microcapsules 48$M_1$ and 48$M_2$.

Of course, a magenta density of the magenta dot, colored by only the first magenta-ink $M_1$, is different from that of the magenta dot colored by both the first and second magenta-inks $M_1$ and $M_2$, thereby obtaining a variation in density (gradation) of the magenta dot.

Further, the third driver circuit 31Y selectively and electrically energizes a plurality of electric resistance elements $R_{y1}$ to $R_{yn}$ in accordance with a single-line of yellow image-pixel signals, each of which carries 2-bit gradation-signal.

In particular, when a digital yellow image-pixel signal has a value "0", and when a 2-bit gradation-signal carried thereby has a value [00], a corresponding electric resistance element ($R_{y1}, \ldots, R_{yn}$) is not electrically energized, thereby producing no yellow dot on the image-forming sheet 40.

If a digital yellow image-pixel signal has a value "1", and if a 2-bit digital gradation signal carried thereby has a value [01], a corresponding electric resistance element ($R_{y1}, \ldots, R_{yn}$) is electrically energized so as to be heated to a temperature $TY_1$ (135° C.), thereby producing a yellow dot, colored by only the molten yellow-ink $Y_1$, on the image-forming sheet 40. Namely, in this yellow dot, only the fifth type of microcapsules 48$Y_1$ are squashed and broken, resulting in discharge of the molten yellow-ink $Y_1$ from the squashed and broken microcapsules 48$Y_1$.

If a digital yellow image-pixel signal has a value "1", and if a 2-bit digital gradation signal carried thereby has a value [10], a corresponding electric resistance element ($R_{y1}, \ldots, R_{yn}$) is electrically energized so as to be heated to a temperature $TY_2$ (160° C.), thereby producing a yellow dot, colored by both the molten yellow inks $Y_1$ and $Y_2$ on the image-forming sheet 40. Namely, in this yellow dot, both the fifth and sixth types of microcapsules 48$Y_1$ and 48$Y_2$ are squashed and broken, resulting in discharge of the molten yellow-inks $Y_1$ and $Y_2$ from the squashed and broken microcapsules 48$Y_1$ and 48$Y_2$.

Of course, a yellow density of the yellow dot, colored by only the first yellow-ink $Y_1$, is different from that of the yellow dot colored by both the first and second yellow-inks $Y_1$ and $Y_2$, thereby obtaining a variation in density (gradation) of the yellow dot.

Figure 19:
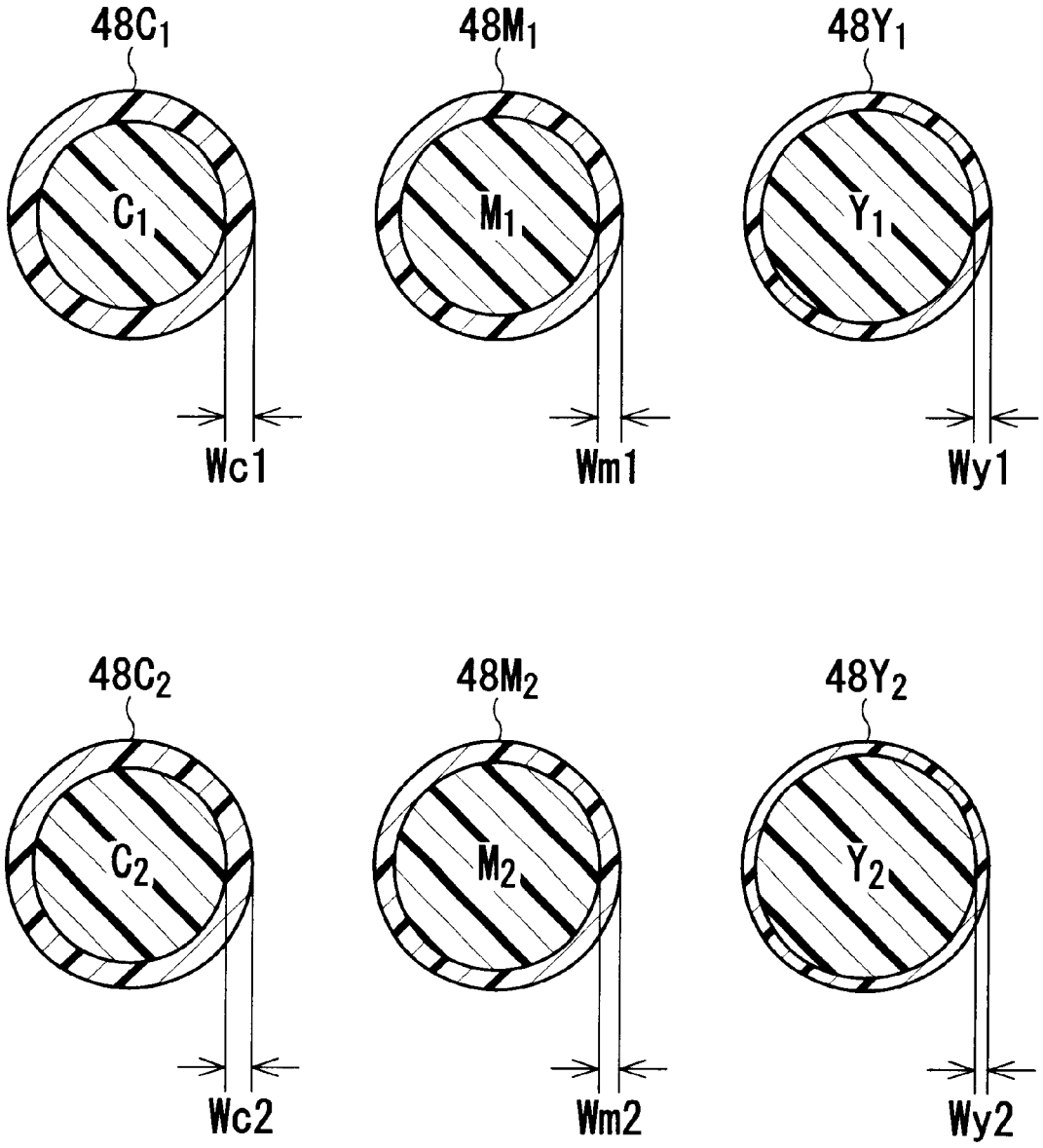
FIG. 19 is a schematic cross sectional view showing different shell thicknesses of first, second, third, fourth, fifth and sixth types of microcapsules used in a modification of the second embodiment of the image-forming substrate shown in FIG. 13.

In a modification of the second embodiment as shown in FIG. 13, the shells of the six types of microcapaules 48$C_1$, 48$C_2$, 48$M_1$, 48$M_2$, 48$Y_1$ and 48$Y_2$ have differing shell thicknesses $W_{c1}$, $W_{c2}$, $W_{m1}$, $W_{m2}$, $W_{y1}$ and $W_{y2}$, respectively, as shown in FIG. 19. The shell thickness $W_{c1}$ of the first type of microcapsule 48$C_1$ is thicker than the shell thickness $W_{c2}$ of the second type of microcapsule 48$C_2$ which is thicker than the shell thickness $W_{m1}$ of the third type of microcapsule 48$M_1$. Also, the shell thickness $W_{m1}$ of the third type of microcapsule 48$M_1$ is thicker than the shell thickness $W_{m2}$ of the fourth type of microcapsule 48$M_2$, which is thicker than the shell thickness $W_{y1}$ of the fifth type of microcapsule 48$Y_1$. Further, the shell thickness $W_{y1}$ of the fifth type of microcapsule 48$Y_1$ is thicker than the shell thickness $W_{y2}$ of the sixth type of microcapsule 48$Y_2$.

According to this modified embodiment, the shell thickness $W_{c1}$ of the first type of microcapsule 48$C_1$ is selected such that each cyan microcapsule 48$C_1$ is squashed and broken under a pressure more than a predetermined critical pressure 10 MPa when each cyan microcapsule 48$C_1$ is heated to a temperature more than the melting point of about 60° C. (FIG. 15) of the first solid cyan-ink $C_1$, and the shell thickness $W_{c2}$ of the second type of microcapsule 48$C_2$ is selected such that each cyan microcapsule 48$C_2$ is squashed and broken under a pressure that lies between a predetermined critical pressure of 2.0 MPa and the predetermined critical pressure of 10 MPa when each cyan microcapsule 48$C_2$ is heated to a temperature more than the melting point of about 75° C. (FIG. 15) of the second solid cyan-ink $C_2$.

Also, the shell thickness $W_{m1}$ of the third type of microcapsule 48$M_1$ is selected such that each magenta microcapsule 48$M_1$ is squashed and broken under a pressure that lies between a predetermined critical pressure of 1.0 MPa and the predetermined critical pressure of 2.0 MPa when each magenta microcapsule 48$M_1$ is heated to a temperature more than the melting point of about 90° C. (FIG. 15) of the first solid magenta-ink $M_1$, and the shell thickness $W_{m2}$ of the fourth type of microcapsule 48$M_2$ is selected such that each magenta microcapsule 48$M_2$ is squashed and broken under a pressure that lies between a predetermined critical pressure of 0.2 MPa and the predetermined critical pressure of 1.0 MPa when each magenta microcapsule 48$M_2$ is heated to a temperature more than the melting point of about 110° C. (FIG. 15) of the second solid magenta-ink $M_2$.

Further, the shell thickness $W_{y1}$ of the fifth type of microcapsule 48$Y_1$ is selected such that each yellow microcapsule 48$Y_1$ is squashed and broken under a pressure that lies between a predetermined critical pressure of 0.1 MPa and the predetermined critical pressure of 0.2 MPa when each yellow microcapsule 48$Y_1$ is heated to a temperature more than the melting point of about 130° C. (FIG. 15) of the first solid yellow-ink $Y_1$, and the shell thickness $W_{y2}$ of the sixth type of microcapsule 48$Y_2$ is selected such that each yellow microcapsule 48$Y_2$ is squashed and broken under a pressure that lies between a predetermined critical pressure of 0.02 MPa and the predetermined critical pressure of 0.1 MPa when each yellow microcapsule 48$Y_2$ is heated to a temperature more than the melting point of about 150° C. (FIG. 15) of the second solid yellow-ink $Y_2$.

Figure 20:
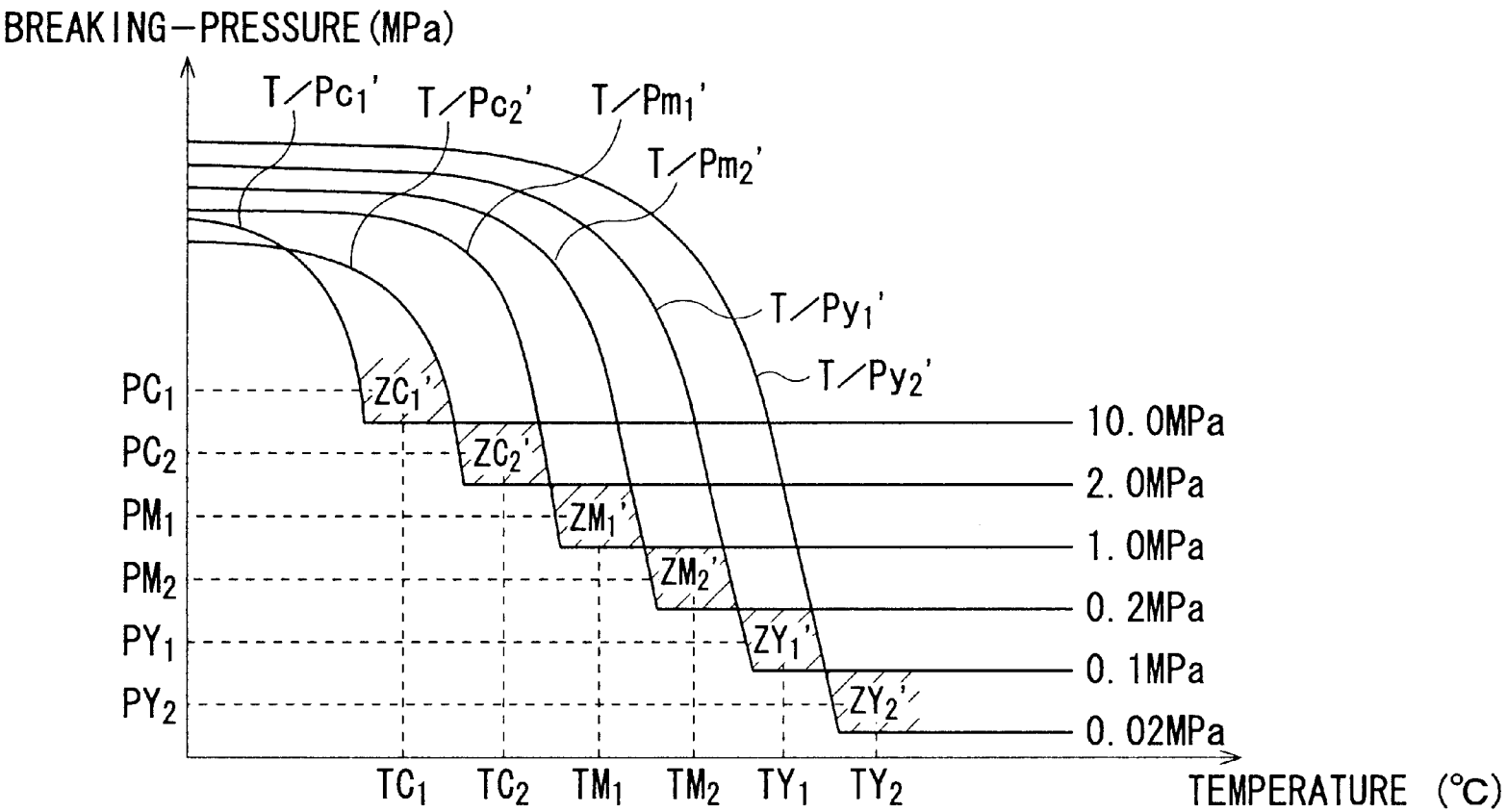
FIG. 20 is a graph showing temperature/pressure breaking characteristics of the first, second, third, fourth, fifth and sixth types of microcapsules shown in FIG. 19, with each of a first cyan-developing zone, a second cyan-developing zone, a first magenta-developing zone, a second magenta-developing zone, a first yellow-developing zone and a second yellow-developing zone being indicated as a hatched zone.

Thus, as shown in a graph of FIG. 20, it is possible to obtain a temperature/pressure breaking characteristic $T/P_{c1}'$ of the first type of microcapsule 48$C_1$, a temperature/pressure breaking characteristic $T/P_{c2}'$ of the second type of micro-capsule 48$C_2$, a temperature/pressure breaking characteristic $T/P_{m1}'$ of the third type of microcapsule 48$M_1$, a temperature/pressure breaking characteristic $T/P_{m2}'$ of the fourth type of microcapsule 48$M_2$, a temperature/pressure breaking characteristic $T/P_{y1}'$ of the fifth type of microcapsule 48$Y_1$, a temperature/pressure breaking characteristic $T/P_{y2}'$ of the sixth type of microcapsule 48$Y_2$; and these characteristics $T/P_{c1}'$, $T/P_{c2}'$, $T/P_{m1}'$, $T/P_{m2}'$, $T/P_{y1}'$ and $T/P_{y2}'$ define a first hatched cyan-developing zone $ZC_1'$, a second hatched cyan-developing zone $ZC_2'$, a first hatched magenta-developing zone $ZM_1'$, a second magenta-developing zone $ZM_2'$, a first hatched yellow-developing zone $ZY_1'$, and a second hatched yellow-developing zone $ZY_2'$. Accordingly, by suitably selecting a heating temperature and a breaking pressure, which should be locally exerted on the image-forming sheet 40, it is possible to selectively squash and break the first, second, third, fourth, fifth and sixth types of microcapsules 48$C_1$, 48$C_2$, 48$M_1$, 48$M_2$, 48$Y_1$ and 48$Y_2$ at the localized area of the image-forming sheet 40 on which the heating temperature and the breaking pressure are exerted.

In particular, for example, as shown in FIG. 20, if a heating temperature $TC_1$ and a breaking pressure $PC_1$, which should be locally exerted on the image-forming sheet 40, are selected so as to fall within the first hatched cyan-developing zone $ZC_1$', only the first type of microcapsule 48$C_1$ is squashed and broken at the localized area of the image-forming sheet 40 on which the heating temperature $TC_1$ and the breaking pressure $PC_1$ are exerted, resulting in discharge of the molten cyan-ink $C_1$ from the squashed and broken microcapsules 48$C_1$. If a heating temperature $TC_2$ and the breaking pressure $PC_2$, which should be locally exerted on the image-forming sheet 40, are selected so as to fall within the second hatched cyan-developing zone $ZC_2$', only the second type of microcapsule 48$C_2$ is squashed and broken at the localized area of the image-forming sheet 40 on which the heating temperature $TC_2$ and the breaking pressure $PC_2$ are exerted, resulting in discharge of the molten cyan-ink $C_2$ from the squashed and broken microcapsules 48$C_2$.

Also, as shown in FIG. 20, if a heating temperature $TM_1$ and a breaking pressure $PM_1$, which should be locally exerted on the image-forming sheet 40, are selected so as to fall within the first hatched magenta-developing zone $ZM_1$', only the third type of microcapsule 48$M_1$ is squashed and broken at the localized area of the image-forming sheet 40 on which the heating temperature $TM_1$ and the breaking pressure $PM_1$ are exerted, resulting in discharge of the molten magenta-ink $M_1$ from the squashed and broken microcapsules 48$M_1$. If a heating temperature $TM_2$ and the breaking pressure $PM_2$, which should be locally exerted on the image-forming sheet 40, are selected so as to fall within the second hatched magenta-developing zone $ZM_2$', only the fourth type of microcapsule 48$M_2$ is squashed and broken at the localized area of the image-forming sheet 40 on which the heating temperature $TM_2$ and the breaking pressure $PM_2$ are exerted, resulting in discharge of the molten magenta-ink $M_2$ from the squashed and broken microcapsules 48$M_2$.

Further, as shown in FIG. 20, if a heating temperature $TY_1$ and a breaking pressure $PY_1$ which should be locally exerted on the image-forming sheet 40, are selected so as to fall within the first hatched yellow-developing zone $ZY_1$', only the fifth type of microcapsule 48$Y_1$ is squashed and broken at the localized area of the image-forming sheet 40 on which the heating temperature $TY_1$ and the breaking pressure $PY_1$ are exerted, resulting in discharge of the molten yellow-ink $Y_1$ from the squashed and broken microcapsules 48$Y_1$. If a heating temperature $TY_2$ and the breaking pressure $PY_2$ which should be locally exerted on the image-forming sheet 40, are selected so as to fall within the second hatched yellow-developing zone $ZY_2$', only the sixth type of microcapsule 48$Y_2$ is squashed and broken at the localized area of the image-forming sheet 40 on which the heating temperature $TY_2$ and the breaking pressure $PY_2$ are exerted, resulting in discharge of the molten yellow-ink $Y_2$ from the squashed and broken microcapsules 48$Y_2$.

Note, in the modification of the second embodiment, the heating temperatures $TC_1$, $TC_2$, $TM_1$, $TM_2$, $TY_1$ and $TY_2$ maybe 65° C., 80° C., 95° C., 115° C., 135° C. and 160° C., respectively, and the breaking pressures $PC_1$, $PC_2$, $PM_1$, $PM_2$, $PY_1$ and $PY_2$ may be 15 MPa, 5.0 MPa, 1.5 MPa, 0.5 MPa, 0.15 MPa and 0.05 MPa, respectively.

Similar to the second embodiment, in this modified embodiment, it is possible to obtain a variation in density (gradation) of the color image-pixel dots produced on the image-forming sheet 40. Of course, before the variation in density (gradation) of the color image-pixel dots can be obtained, each of the digital color image-pixel signals preferably carries a digital 2-bit gradation-signal.

Figure 21:
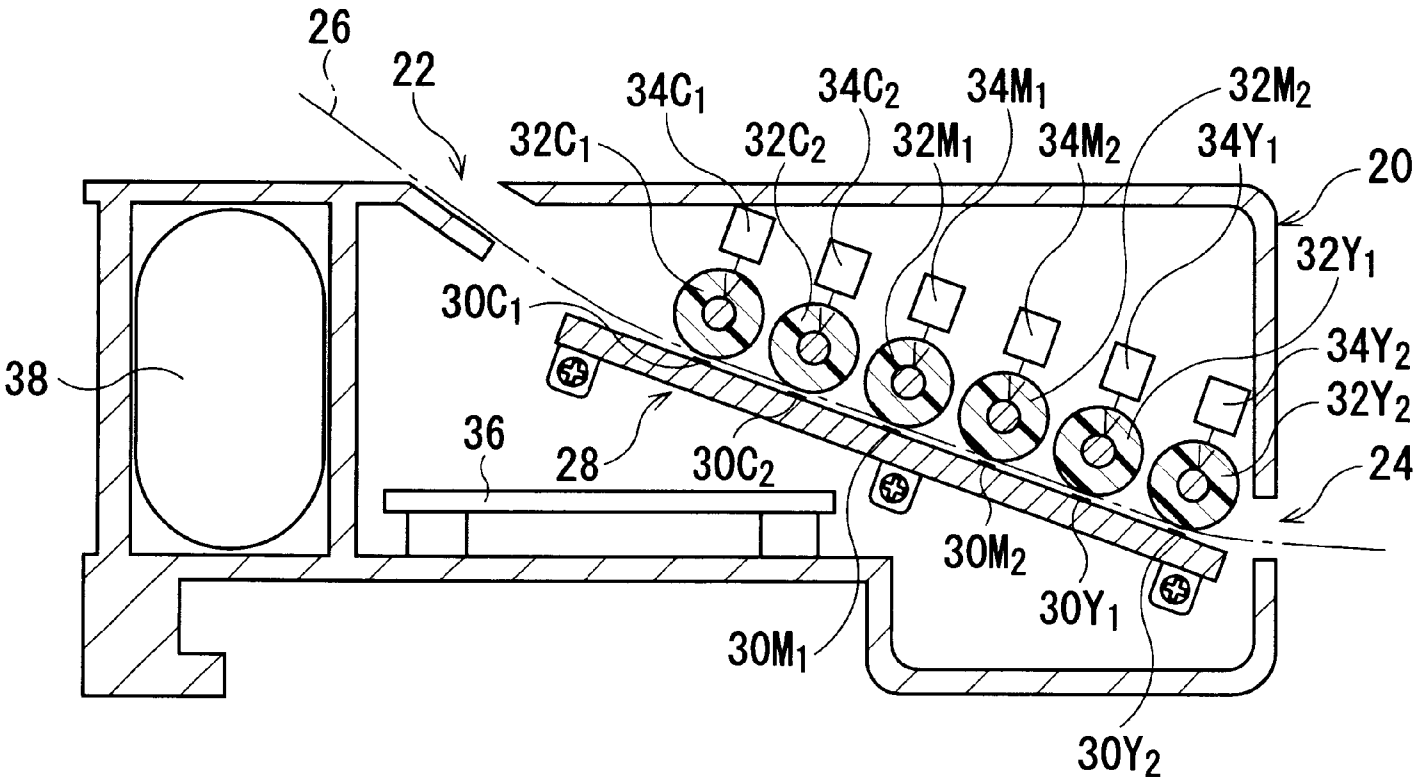
FIG. 21 is a schematic cross sectional view of a line type color printer for forming and recording a color image on the modified image-forming substrate using the first, second, third, fourth, fifth and sixth types of microcapsules shown in FIG. 19.

FIG. 21 schematically shows a thermal color printer, which is constituted as a line printer so as to form a color image on the modified image-forming sheet 40 featuring the temperature/pressure breaking characteristics $T/P_{c1}$', $T/P_{c2}$', $T/P_{m1}$', $T/P_{m2}$', $T/P_{y1}$' and $T/P_{Y2}$', as shown in FIG. 20. As is apparent from FIG. 21, this thermal line printer is similar to that shown in FIG. 9, and thus, in this drawing, the features similar to those of FIG. 9 are indicated by the same reference numerals.

The color printer comprises a generally-rectangular parallelopiped housing 20 having an entrance opening 22 and an exit opening 24 formed in a top wall and a side wall of the housing 20, respectively. The modified image-forming sheet 40 (not shown in FIG. 21) is introduced into the housing 20 through the entrance opening 22, and is then discharged from the exit opening 24 after the formation of a color image on the modified image-forming sheet 40. Note, in FIG. 21, a path 26 for movement of the modified image-forming sheet 40 is indicated by a chained line.

A guide plate 28 is provided in the housing 20 so as to define a part of the path 26 for the movement of the modified image-forming sheet 40, and a first set of thermal heads 30$C_1$ and 30$C_2$, a second set of thermal heads 30$M_1$ and 30$M_2$ and a third set of thermal heads 30$Y_1$ and 30$Y_2$ are securely attached to a surface of the guide plate 28. These thermal heads 30$C_1$ and 30$C_2$; 30$M_1$ and 30$M_2$; and 30$Y_1$ and 30$Y_2$ are essentially identical to each other, and each thermal head is formed as a line thermal head extending perpendicularly with respect to a direction of movement of the modified image-forming sheet 40. Each of the thermal heads 30$C_1$ and 30$C_2$; 30$M_1$ and 30$M_2$; and 30$Y_1$ and 30$Y_2$ includes a plurality of heater elements or electric resistance elements, and these electric resistance elements are aligned with each other along a length of the corresponding line thermal head (30$C_1$, 30$C_2$; 30$M_1$, 30$M_2$; 30$Y_1$, 30$Y_2$).

The first set of thermal heads 30$C_1$ and 30$C_2$ is used to form a cyan-dotted image on the modified image-forming sheet 40, and a pair of corresponding electric resistance elements, included in the thermal heads 30$C_1$ and 30$C_2$, is selectively and electrically energized to produce a cyan-image-pixel dot in accordance with a digital cyan image-pixel signal carrying a 2-bit digital gradation signal. When the digital cyan image-pixel signal has a value "0", the corresponding pair of electric resistance elements is not electrically energized. When the digital cyan image-pixel signal has a value "1", at least one of the corresponding pair of electric resistance elements is electrically energized in accordance with the 2-bit digital gradation signal carried by the digital cyan image-pixel signal. In either case, whenever one of the electric resistance elements, included in the thermal head 30$C_1$, is electrically energized, it is heated to the heating temperature $TC_1$ (65° C.). Also, whenever one of the electric resistance elements, included in the thermal head 30$C_2$ is electrically energized, it is heated to the heating temperature $TC_2$ (80° C.).

Similarly, the second set of thermal heads 30$M_1$ and 30$M_2$ is used to form a magenta-dotted image on the modified image-forming sheet 40, and a pair of corresponding electric resistance elements, included in the thermal heads 30$M_1$ and 30$M_2$, is selectively and electrically energized to produce a magenta-image-pixel dot in accordance with a digital magenta image-pixel signal carrying a 2-bit digital gradation signal. When the digital magenta image-pixel signal has a value "0", the corresponding pair of electric resistance elements is not electrically energized. When the digital magenta image-pixel signal has a value "1", at least one of the corresponding pair of electric resistance elements is electrically energized in accordance with the 2-bit digital gradation signal carried by the digital magenta image-pixel signal. In either case, whenever one of the electric resistance elements, included in the thermal head 30$M_1$, is electrically energized, it is heated to the heating temperature $TM_1$ (95° C.). Also, whenever one of the electric resistance elements, included in the thermal head 30$M_2$ is electrically energized, it is heated to the heating temperature $TM_2$ (115° C.).

Further, the third set of thermal heads 30$Y_1$ and 30$Y_2$ is used to form a yellow-dotted image on the modified image-forming sheet 40, and a pair of corresponding electric resistance elements, included in the thermal heads 30$Y_1$ and 30$Y_2$, is selectively and electrically energized to produce a yellow-image-pixel dot in accordance with a digital yellow image-pixel signal carrying a 2-bit digital gradation signal. When the digital yellow image-pixel signal has a value "0", the corresponding pair of electric resistance elements is not electrically energized. When the digital yellow image-pixel signal has a value "1", at least one of the corresponding pair of electric resistance elements is electrically energized in accordance with the 2-bit digital gradation signal carried by the digital yellow image-pixel signal. In either case, whenever one of the electric resistance elements, included in the thermal head 30$Y_1$, is electrically energized, it is heated to the heating temperature $TY_1$ (135° C.). Also, whenever one of the electric resistance elements, included in the thermal head 30$Y_2$ is electrically energized, it is heated to the heating temperature $TY_2$ (160° C.).

Note, the line thermal heads 30$C_1$, 30$C_2$, 30$M_1$, 30$M_2$, 30$Y_1$ and 30$Y_2$ are arranged in sequence so that the respective heating temperatures increase in the movement direction of the modified image-forming sheet 40.

The color printer further comprises a first set of roller platens 32$C_1$ and 32$C_2$ associated with the first set of thermal heads 30$C_1$ and 30$C_2$, a second set of roller platens 32$M_1$ and 32$M_2$ associated with the second set thermal heads 30$M_1$ and 30$M_2$, and a third set of roller platens 32$Y_1$ and 32$Y_2$ associated with the third set of thermal heads 30$Y_1$ and 30$Y_2$, and each of the roller platens 32$C_1$ and 32$C_2$; 32$M_1$ and 32$M_2$; and 32$Y_1$ and 32$Y_2$ may be formed of a hard rubber material.

The first set of roller platens 32$C_1$ and 32$C_2$ is provided with a first set of spring-biasing units 34$C_1$ and 34$C_2$. The roller platen 32$C_1$ is elastically pressed against the thermal head 30$C_1$ by the spring-biasing unit 34$C_1$ at the breaking pressure $PC_1$ (15 MPa), and the roller platen 32$C_2$ is elastically pressed against the thermal head 30$C_2$ by the spring-biasing unit 34$C_2$ at the breaking pressure $PC_2$ (5.0 MPa).

The second set of roller platens 32$M_1$ and 32$M_2$ is provided with a second set of spring-biasing units 34$M_1$ and 34$M_2$. The roller platen 32$M_1$ is elastically pressed against the thermal head 30$M_1$ by the spring-biasing unit 34$M_1$ at the breaking pressure $PM_1$ (1.5 MPa), and the roller platen 32$M_2$ is elastically pressed against the thermal head 30$M_2$ by the spring-biasing unit 34$M_2$ at the breaking pressure $PM_2$ (0.5 MPa).

The third set of roller platens 32$Y_1$ and 32$Y_2$ is provided with a third set of spring-biasing units 34$Y_1$ and 34$Y_2$. The roller platen 32$Y_1$ is elastically pressed against the thermal head 30$Y_1$ by the spring-biasing unit 34$Y_1$ at the breaking pressure $PY_1$ (0.15 MPa), and the roller platen 32$Y_2$ is elastically pressed against the thermal head 30$Y_2$ by the spring-biasing unit 34$Y_2$ at the breaking pressure $PY_2$ (0.05 MPa).

Note, the roller platens 32$C_1$, 32$C_2$, 32$M_1$, 32$M_2$, 32$Y_1$ and 32$Y_2$ are arranged in sequence so that the respective pressures, exerted by the platens 32$C_1$ and 32$C_2$; 32$M_1$ and 32$M_2$; and 32$Y_1$ and 32$Y_2$ on the line thermal heads 30$C_1$ and 30$C_2$; 30$M_1$ and 30$M_2$; and 30$Y_1$ and 30$Y_2$, decrease in the movement direction of the modified image-forming sheet 40.

Similar to FIG. 9, in FIG. 21, reference 36 indicates a control circuit board for controlling a printing operation of the color printer, and reference 38 indicates an electrical main power source for electrically energizing the control circuit board 36.

As mentioned above, a pair of corresponding electric resistance elements, included in the thermal heads 30$C_1$ and 30$C_2$, is selectively and electrically energized to produce a cyan-image-pixel dot in accordance with a digital cyan image-pixel signal carrying a 2-bit digital gradation signal.

In particular, when a digital cyan image-pixel signal has a value "0", and when a 2-bit gradation-signal carried thereby has a value [00], a pair of corresponding electric resistance elements, included in the thermal heads 30$C_1$ and 30$C_2$, is not electrically energized, thereby producing no cyan dot on the modified image-forming sheet 40.

Figure 22:
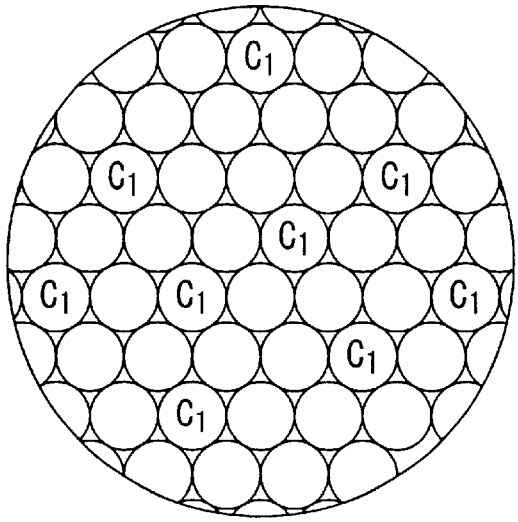
FIG. 22 is a conceptual view showing an example of variation in density (gradation) of a cyan dot produced on the modified image-forming substrate using the first, second, third, fourth, fifth and sixth types of microcapsules shown in FIG. 19.

If a digital cyan image-pixel signal has a value "1", and if a 2-bit digital gradation signal carried thereby has a value [01], only a corresponding electric resistance element, included in the thermal head 30$C_1$, is electrically energized so as to be heated to the heating temperature $TC_1$ (65° C.), thereby producing a cyan dot, colored by only the molten cyan-ink $C_1$, on the modified image-forming sheet 40. Namely, as conceptually shown in FIG. 22, in this cyan dot, only the first type of microcapsule 48$C_1$ is squashed and broken, resulting in discharge of the molten cyan-ink $C_1$ from the squashed and broken microcapsules 48$C_1$.

Figure 23:
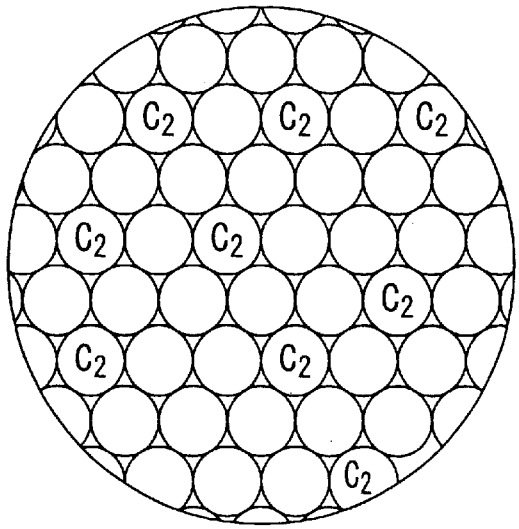
FIG. 23 is a conceptual view showing another example of variation in density (gradation) of a cyan dot produced on the modified image-forming substrate using the first, second, third, fourth, fifth and sixth types of microcapsules shown in FIG. 19.

If a digital cyan image-pixel signal has a value "1", and if a 2-bit digital gradation signal carried thereby has a value [10], only a corresponding electric resistance element, included in the thermal head 30$C_2$, is electrically energized so as to be heated to the heating temperature $TC_2$ (80° C.), thereby producing a cyan dot, colored by only the molten cyan-ink $C_2$, on the modified image-forming sheet 40. Namely, as conceptually shown in FIG. 23, in this cyan dot, only the second type of microcapsule 48$C_1$ is squashed and broken, resulting in discharge of the molten cyan-ink $C_2$ from the squashed and broken microcapsules 48$C_2$.

Figure 24:
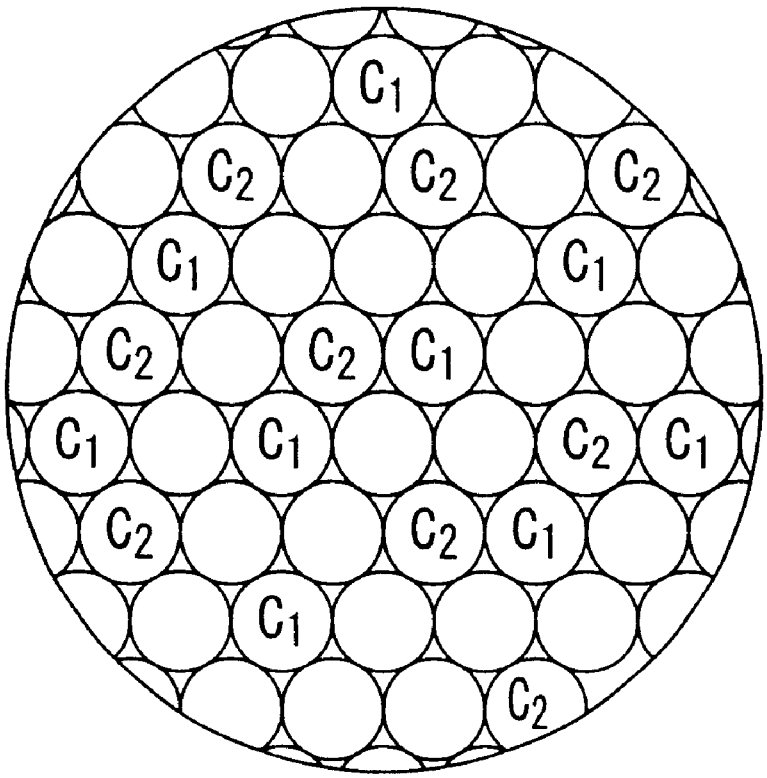
FIG. 24 is a conceptual view showing yet another example of variation in density (gradation) of a cyan dot produced on the modified image-forming substrate using the first, second, third, fourth, fifth and sixth types of microcapsules shown in FIG. 19.

If a digital cyan image-pixel signal has a value "1", and if a 2-bit digital gradation signal carried thereby has a value [11], a corresponding electric resistance element, included in the thermal head 30$C_1$ is electrically energized so as to be heated to the heating temperature $TC_1$ (65° C.), and then a corresponding electric resistance element, included in the thermal head 30$C_2$ is electrically energized so as to be heated to the heating temperature $TC_2$ (80° C.) thereby producing a cyan dot, colored by the molten cyan-inks $C_1$ and $C_2$, on the modified image-forming sheet 40. Namely, as conceptually shown in FIG. 24, in this cyan dot, both the first and second types of microcapsules 48$C_1$ and 48$C_2$ are squashed and broken, resulting in discharge of the molten cyan-inks $C_1$ and $C_2$ from the squashed and broken microcapsules 48$C_1$ and 48$C_2$.

In short, by selectively discharging the first and second cyan-ink $C_1$ and $C_2$ from the first and second types of microcapsules 48$C_1$ and 48$C_2$ it is possible to obtain a variation in density (gradation) of a cyan dot to be produced on the modified image-forming sheet 40.

Also, as mentioned above, a pair of corresponding electric resistance elements, included in the thermal heads 30$M_1$ and 30$M_2$, is selectively and electrically energized to produce a magenta-image-pixel dot in accordance with a digital magenta image-pixel signal carrying a 2-bit digital gradation signal.

In particular, when a digital magenta image-pixel signal has a value "0", and when a 2-bit gradation-signal carried thereby has a value [00], a pair of corresponding electric resistance elements, included in the thermal heads 30$M_1$ and 30$M_2$, is not electrically energized, thereby producing no magenta dot on the modified image-forming sheet 40.

If a digital magenta image-pixel signal has a value "1", and if a 2-bit digital gradation signal carried thereby has a value [01], only a corresponding electric resistance element, included in the thermal head 30$M_1$, is electrically energized so as to be heated to the heating temperature $TM_1$ (95° C.), thereby producing a magenta dot, colored by only the molten magenta-ink $M_1$, on the modified image-forming sheet 40. Namely, in this magenta dot, only the third type of microcapsule 48$M_1$ is squashed and broken, resulting in discharge of the molten magenta-ink $M_1$ from the squashed and broken microcapsules 48$M_1$.

If a digital magenta image-pixel signal has a value "1", and if a 2-bit digital gradation signal carried thereby has a value [10], only a corresponding electric resistance element, included in the thermal head 30$M_2$, is electrically energized so as to be heated to the heating temperature $TM_2$ (115° C.), thereby producing a magenta dot, colored by only the molten magenta-ink $M_2$, on the modified image-forming sheet 40. Namely, in this magenta dot, only the fourth type of microcapsule 48$M_1$ is squashed and broken, resulting in discharge of the molten magenta-ink $M_2$ from the squashed and broken microcapsules 48$M_2$.

If a digital magenta image-pixel signal has a value "1", and if a 2-bit digital gradation signal carried thereby has a value [11], a corresponding electric resistance element, included in the thermal head 30$M_1$, is electrically energized so as to be heated to the heating temperature $TM_1$ (95° C.), and then a corresponding electric resistance element, included in the thermal head 30$M_2$, is electrically energized so as to be heated to the heating temperature $TM_2$ (115° C.) thereby producing a magenta dot, colored by the molten magenta-inks $M_1$ and $M_2$, on the modified image-forming sheet 40. Namely, in this magenta dot, both the third and fourth types of microcapsules 48$M_1$ and 48$M_2$ are squashed and broken, resulting in discharge of the molten magenta-inks $M_1$ and $M_2$ from the squashed and broken microcapsules 48$M_1$ and 48$M_2$.

In short, by selectively discharging the third and fourth magenta-ink $M_1$ and $M_2$ from the third and fourth types of microcapsules 48$M_1$ and 48$M_2$, it is possible to obtain a variation in density (gradation) of a magenta dot to be produced on the modified image-forming sheet 40.

Further, as mentioned above, a pair of corresponding electric resistance elements, included in the thermal heads 30$Y_1$ and 30$Y_2$, is selectively and electrically energized to produce a yellow-image-pixel dot in accordance with a digital yellow image-pixel signal carrying a 2-bit digital gradation signal.

In particular, when a digital yellow image-pixel signal has a value "0", and when a 2-bit gradation-signal carried thereby has a value [00], a pair of corresponding electric resistance elements, included in the thermal heads 30$Y_1$ and 30$Y_2$, is not electrically energized, thereby producing no yellow dot on the modified image-forming sheet 40.

If a digital yellow image-pixel signal has a value "1", and if a 2-bit digital gradation signal carried thereby has a value [01], only a corresponding electric resistance element, included in the thermal head 30$Y_1$, is electrically energized so as to be heated to the heating temperature $TY_1$ (135° C.), thereby producing a yellow dot, colored by only the molten yellow-ink $Y_1$, on the modified image-forming sheet 40. Namely, in this yellow dot, only the fifth type of microcapsule 48$Y_1$ is squashed and broken, resulting in discharge of the molten yellow-ink $Y_1$ from the squashed and broken microcapsules 48$Y_1$.

If a digital yellow image-pixel signal has a value "1", and if a 2-bit digital gradation signal carried thereby has a value [10], only a corresponding electric resistance element, included in the thermal head 30$Y_2$, is electrically energized so as to be heated to the heating temperature $TY_2$ (160° C.), thereby producing a yellow dot, colored by only the molten yellow-ink $Y_2$, on the modified image-forming sheet 40. Namely, in this yellow dot, only the sixth type of microcapsule 48$Y_2$ is squashed and broken, resulting in discharge of the molten yellow-ink $Y_2$ from the squashed and broken microcapsules 48$Y_2$.

If a digital yellow image-pixel signal has a value "1", and if a 2-bit digital gradation signal carried thereby has a value [11], a corresponding electric resistance element, included in the thermal head 30$Y_1$, is electrically energized so as to be heated to the heating temperature $TY_1$ (135° C.), and then a corresponding electric resistance element, included in the thermal head 30$Y_2$, is electrically energized so as to be heated to the heating temperature $TY_2$ (160° C.) thereby producing a yellow dot, colored by the molten yellow-inks $Y_1$ and $Y_2$, on the modified image-forming sheet 40. Namely, in this yellow dot, both the fifth and sixth types of microcapsules 48$Y_1$ and 48$Y_2$ are squashed and broken, resulting in discharge of the molten yellow-inks $Y_1$ and $Y_2$ from the squashed and broken microcapsules 48$Y_1$ and 48$Y_2$.

In short, by selectively discharging the fifth and sixth yellow-ink $Y_1$ and $Y_2$ from the fifth and sixth types of microcapsules 48$Y_1$ and 48$Y_2$, it is possible to obtain a variation in density (gradation) of a yellow dot to be produced on the modified image-forming sheet 40.

Figure 25:
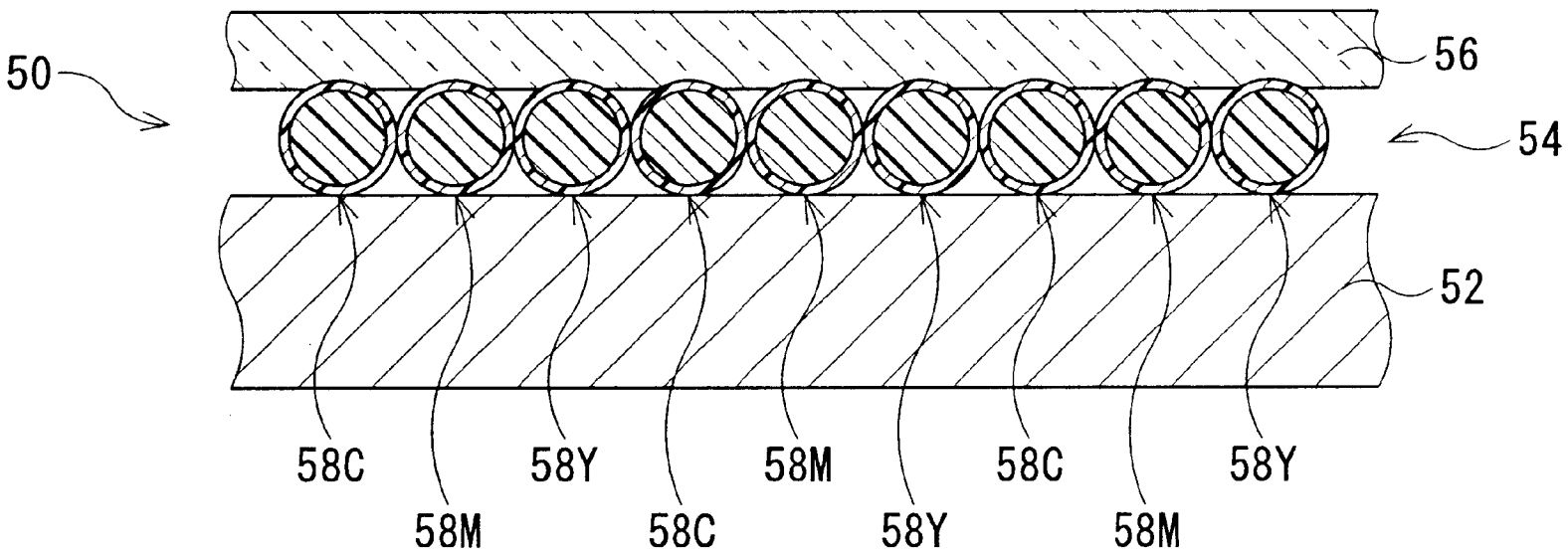
FIG. 25 is a schematic conceptual cross sectional view showing a third embodiment of an image-forming substrate, according to the present invention, comprising a layer of microcapsules including a first type of microcapsule filled with a solid cyan-ink exhibiting a thermal melting point falling within a first melting-point range, a second type of microcapsule filled with a solid magenta ink exhibiting a thermal melting point falling within a second melting-point range and a third type of microcapsule filled with a solid yellow-ink exhibiting a thermal melting point falling within a third melting-point range.

FIG. 25 shows a third embodiment of an image-forming substrate, generally indicated by reference 50, which is also produced in a form of paper sheet. In particular, similar to the first embodiment, the image-forming sheet 50 comprises a sheet of paper 52, a layer of microcapsules 54 coated over a surface of the sheet of paper 52, and a sheet of protective transparent film or ultraviolet barrier film 56 covering the layer of microcapsules 54. The microcapsule layer 54 is formed of a plurality of microcapsules comprising three types of microcapsules 58C, 58M and 58Y uniformly distributed over the surface of the paper sheet 52.

According to the third embodiment, the first type of microcapsule 58C is filled with a solid cyan-ink exhibiting a thermal melting point which falls within a melting-point range of about 60° C. to about 90° C., and a shell of each microcapsule 58C is constituted so as to be squashed and broken under a pressure more than a predetermined critical pressure of 20 MPa when a solid cyan-ink, encapsulated in each cyan microcapsule 58C, is thermally melted.

The first type of microcapsule 58C may be produced as follows:

a) A first solid cyan-ink material, which is composed of microcrystalline wax exhibiting a melting point of about 100° C. and phthalocyanine blue as a cyan pigment, and a second solid cyan-ink material, which is composed of paraffin wax exhibiting a melting point of about 60° C. and phthalocyanine blue as a cyan pigment, are prepared. Note, a cyan density of the first solid cyan-ink material is equal to that of the second solid cyan-ink material.

b) A rod-like solid cyan-ink material is extruded from the first and second solid cyan-ink materials by an extruder such that a content of the second solid cyan-ink material in the first solid cyan-ink material gradually increases from a leading end of the rod-like solid cyan-ink material toward a trailing end thereof. As is well known, in general, when a wax material exhibiting a low melting point is added to and mixed with a wax material exhibiting a high melting point, a resultant melting point of the mixed wax material becomes lower than the high melting point of the latter wax material. Namely, it is possible to obtain the rod-like solid cyan-ink material, which exhibits a melting point of about 90° C. at the leading end thereof, and which exhibits a melting point of about 60° C. at the trailing end thereof, with the melting point gradually decreasing from the leading end of the rod-like solid cyan-ink material toward the trailing end thereof.

c) By using, for example, a jet mill, the rod-like solid cyan-ink is powdered into a plurality of solid cyan-ink particles having an average of several microns, for example, 5$\mu$ to 10$\mu$, and then the plurality of solid cyan-ink particles is introduced into the aforementioned "HYBRIDIZER" such that each solid cyan-ink particle is encapsulated with a melamine resin shell, resulting in achievement of the production of the first type of microcapsule 58C. Of course, a thickness of the melamine shell is selected such that each cyan microcapsule 58C is squashed and broken under a pressure more than the predetermined critical pressure of 20 MPa when a solid cyan-ink, encapsulated in each cyan microcapsule 58C, is thermally melted.

Also, the second type of microcapsule 58M is filled with a solid magenta-ink exhibiting a thermal melting point which falls within a melting-point range of about 100° C. to about 120° C., and a shell of each microcapsule 58M is constituted so as to be squashed and broken under a pressure that lies between a predetermined critical pressure of 2.0 MPa and the predetermined critical pressure of 20 MPa when a solid magenta-ink, encapsulated in each magenta microcapsule 58M, is thermally melted.

The second type of microcapsule 58M may be produced as follows:

a) A first solid magenta-ink material, which is composed of olefin wax exhibiting a melting point of about 130° C. and rhodamine lake T as a magenta pigment, and a second solid magenta-ink material, which is composed of microcrystalline wax exhibiting a melting point of about 100° C. and rhodamine lake T as a magenta pigment, are prepared. Note, a magenta density of the first solid magenta-ink material is equal to that of the second solid magenta-ink material.

b) A rod-like solid magenta-ink material is extruded from the first and second solid magenta-ink materials by an extruder such that a content of the second solid magenta-ink material in the first solid magenta-ink material gradually increases from a leading end of the rod-like solid magenta-ink material toward a trailing end thereof. Namely, the rod-like solid magenta-ink material, which exhibits a melting point of about 120° C. at the leading end thereof, and which exhibits a melting point of about 100° C. at the trailing end thereof, is obtained, with the melting point gradually decreasing from the leading end of the rod-like solid magenta-ink material toward the trailing end thereof.

c) The second type of microcapsule 58M is produced from the rod-like solid magenta-ink material in substantially the same manner as the first type of microcapsule 58C. Of course, a melamine shell thickness of the second type of microcapsule 58M is selected such that each magenta microcapsule 58M is squashed and broken under a pressure that lies between the predetermined critical pressure of 2.0 MPa and the predetermined critical pressure of 20 MPa when a solid magenta-ink, encapsulated in each magenta microcapsule 58M, is thermally melted.

Further, the third type of microcapsule 58Y is filled with a solid yellow-ink exhibiting a thermal melting point which falls within a melting-point range of about 130° C. to about 150° C., and a shell of each microcapsule 58Y is constituted so as to be squashed and broken under a pressure that lies between a predetermined critical pressure of 0.2 MPa and the predetermined critical pressure of 2.0 MPa when a solid yellow-ink, encapsulated in each yellow microcapsule 48M, is thermally melted.

The third type of microcapsule 58Y may be produced as follows:

a) A first solid yellow-ink material, which is composed of polypropylene wax exhibiting a melting point of about 150° C. and benzine yellow G as a yellow pigment, and a second solid yellow-ink material, which is composed of olefin wax exhibiting a melting point of about 130° C. and benzine yellow G as a yellow pigment, are prepared. Note, a yellow density of the first solid yellow-ink material is equal to that of the second solid yellow-ink material.

b) A rod-like solid yellow-ink material is extruded from the first and second solid yellow-ink materials by an extruder such that a content of the second solid yellow-ink material in the first solid yellow-ink material gradually increases from a leading end of the rod-like solid yellow-ink material toward a trailing end thereof. Namely, the rod-like solid yellow-ink material, which exhibits a melting point of about 150° C. at the leading end thereof, and which exhibits a melting point of about 130° C. at the trailing end thereof, is obtained, with the melting point gradually decreasing from the leading end of the rod-like solid yellow-ink material toward the trailing end thereof.

c) The second type of microcapsule 58Y is produced from the rod-like solid yellow-ink material in substantially the same manner as the first type of microcapsule 58C. Of course, a melamine shell thickness of the second type of microcapsule 58M is selected such that each yellow microcapsule 58M is squashed and broken under a pressure that lies between the predetermined critical pressure of 0.2 MPa and the predetermined critical pressure of 2.0 MPa when a solid yellow-ink, encapsulated in each yellow microcapsule 58Y, is thermally melted.

Figure 26:
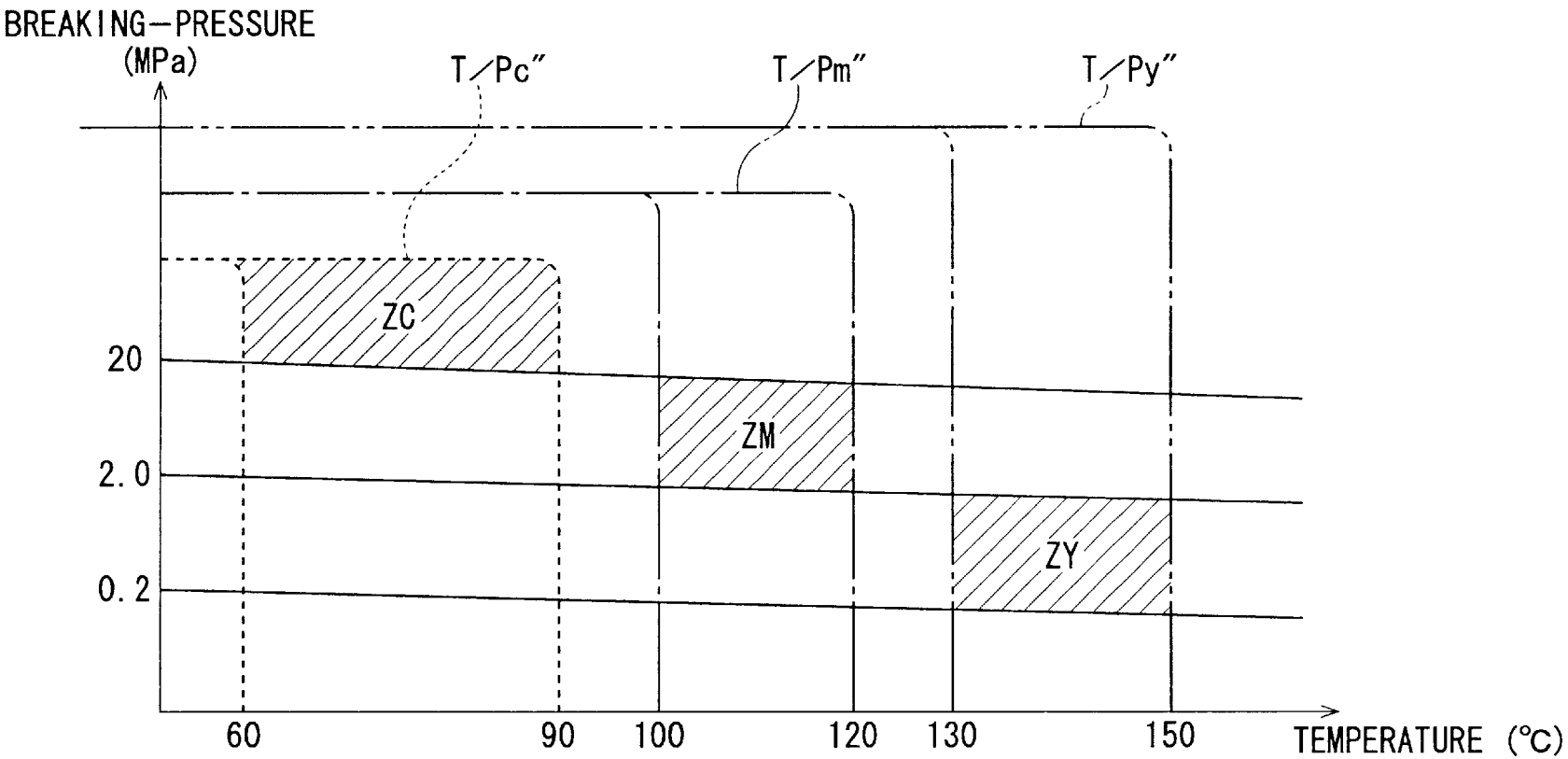
FIG. 26 is a graph showing temperature/pressure breaking characteristics of the first, second and third of microcapsules shown in FIG. 25, with each of a cyan-developing zone, a magenta-developing zone and a yellow-developing zone being indicated as a hatched zone.

Thus, as shown in FIG. 26, it is possible to obtain a temperature/pressure breaking characteristic $T/P_c$" of the first type of microcapsule 58C defining a first hatched cyan-developing zone ZC, a temperature/pressure breaking characteristic $T/P_m$" of the second type of microcapsule 58C defining a second hatched magenta-developing zone ZM, and a temperature/pressure breaking characteristic $T/P_y$" of the third type of microcapsule 58Y defining a third hatched yellow-developing zone ZY. Accordingly, by suitably selecting a heating temperature and a breaking pressure, which should be locally exerted on the image-forming sheet 50, not only can a color image be formed on the image-forming sheet 50 by producing color (yellow, magenta and cyan) image-pixel dots in accordance with digital color image-pixel signals, but also it is possible to obtain a variation in density (gradation) of the color image-pixel dots produced on the image-forming sheet 50. Of course, before the variation in density (gradation) of the color image-pixel dots can be obtained, each of the digital color image-pixel signals should carry a digital gradation-signal.

Similar to the first embodiment, with using a color line printer as shown in FIG. 9, it is possible to form a color image on the image-forming sheet 50 in accordance with three-primary color digital image-pixel signals, in substantially the same manner as mentioned above. Of course, in the third embodiment, before a color image can be formed on the image-forming sheet 50, a first spring-biasing unit 34C should be arranged such that a first roller platen 32C is elastically pressed against a first thermal head 30C at a breaking-pressure, e.g., 25 MPa, more than the predetermined critical pressure of 20 MPa; a second spring-biasing unit 34M should be arranged such that a second roller platen 32M is elastically pressed against a second thermal head 30M at a breaking-pressure, e.g., 3.0 MPa, more than the predetermined critical pressure of 2.0 MPa; and a third spring-biasing unit 34Y should be arranged such that a third roller platen 32Y is elastically pressed against a third thermal head 30Y at a breaking-pressure, e.g., 1.0 MPa, more than the predetermined critical pressure of 0.2 MPa.

Also, the electric resistance elements ($R_{c1}$ to $R_{cn}$; $R_{m1}$ to $R_{mn}$; and $R_{y1}$ to $R_{yn}$) of each thermal head (30C, 30M, 30Y) are selectively and electrically energized by a corresponding driver circuit (31C, 31M, 31Y) in accordance with a single-line of digital monochromatic (cyan, magenta, yellow) image-pixel signals, each of which carries, for example, a 3-bit digital gradation-signal.

In particular, each of the electric resistance elements $R_{c1}$ to $R_{cn}$ is electrically energized in accordance with a value of a digital cyan image-pixel signal and a value of a 3-bit digital gradation-signal carried thereby, for example, as shown in TABLE I of FIG. 27. As is apparent from this TABLE I, if a value of a digital cyan image-pixel signal has a value "0", a corresponding electric resistance element ($R_{cn}$) cannot be energized, thereby producing no cyan dot on the image-forming sheet 50. When a value of a digital cyan image-pixel signal has a value "1", a corresponding electric resistance element ($R_{cn}$) is electrically energized, and a degree of the electrical energization of the resistance element ($R_{cn}$) depends on a value of a 3-bit digital gradation-signal carried by the digital cyan image-pixel signal concerned. Namely, the greater the value of the 3-bit digital gradation-signal, the greater the degree of the electrical energization of the element ($R_{cn}$), resulting in a gradual increase of a heating temperature of the element ($R_{cn}$), as shown in the TABLE I of FIG. 27.

Of course, the higher the heating temperature of the electric resistance element ($R_{cn}$), the greater a number of cyan microcapsules 58C to be squashed and broken within a cyan dot area defined by the heated element ($R_{cn}$) concerned. When the heating of the electric resistance element ($R_{cn}$) has reached a maximum temperature of 90° C., all of the cyan microcapsules are squashed and broken within the cyan dot area defined by the heated element ($R_{cn}$) concerned.

Similarly, each of the electric resistance elements $R_{m1}$ to $R_{mn}$ is electrically energized in accordance with a value of a digital magenta image-pixel signal and a value of a 3-bit digital gradation-signal carried thereby, for example, as shown in TABLE II of FIG. 28. As is apparent from TABLE II, if a value of a digital magenta image-pixel signal has a value "0", a corresponding electric resistance element ($R_{mn}$) cannot be energized, thereby producing no magenta dot on the image-forming sheet 50. When a value of a digital magenta image-pixel signal has a value "1", a corresponding electric resistance element ($R_{mn}$) is electrically energized, and a degree of the electrical energization of the resistance element ($R_{mn}$) depends on a value of a 3-bit digital gradation-signal carried by the digital magenta image-pixel signal concerned. Namely, the greater the value of the 3-bit digital gradation-signal, the greater the degree of the electrical energization of the element ($R_{mn}$), resulting in a gradual increase of a heating temperature of the element ($R_{mn}$), as shown in TABLE II of FIG. 28.

Of course, the higher the heating temperature of the electric resistance element ($R_{mn}$), the greater a number of magenta microcapsules 58M to be squashed and broken within a magenta dot area defined by the heated element ($R_{mn}$) concerned. When the heating of the electric resistance element ($R_{mn}$) has reached a maximum temperature of 120° C., all of the magenta microcapsules are squashed and broken within the magenta dot area defined by the heated element ($R_{mn}$) concerned.

Further, each of the electric resistance elements $R_{y1}$ to $R_{yn}$ is electrically energized in accordance with a value of a digital yellow image-pixel signal and a value of a 3-bit digital gradation-signal carried thereby, for example, as shown in TABLE III of FIG. 29. As is apparent from TABLE III, if a value of a digital yellow image-pixel signal has a value "0", a corresponding electric resistance element ($R_{yn}$) cannot be energized, thereby producing no yellow dot on the image-forming sheet 50. When a value of a digital yellow image-pixel signal has a value "1", a corresponding electric resistance element ($R_{yn}$) is electrically energized, and a degree of the electrical energization of the resistance element ($R_{yn}$) depends on a value of a 3-bit digital gradation-signal carried by the digital yellow image-pixel signal concerned. Namely, the greater the value of the 3-bit digital gradation-signal, the greater the degree of the electrical energization of the element ($R_{yn}$), resulting in a gradual increase of a heating temperature of the element ($R_{yn}$), as shown in TABLE III of FIG. 29.

Of course, the higher the heating temperature of the electric resistance element ($R_{yn}$), the greater a number of yellow microcapsules 58Y to be squashed and broken within a yellow dot area defined by the heated element ($R_{yn}$) concerned. When the heating of the electric resistance element ($R_{yn}$) has reached a maximum temperature of 150° C., all of the yellow microcapsules are squashed and broken within the yellow dot area defined by the heated element ($R_{yn}$) concerned.

In the aforementioned embodiments, a leuco-pigment may be utilized to color a wax material. As is well-known, the leuco-pigment per se exhibits no color. Namely, usually, the leuco-pigment exhibits milky-white or transparency, and reacts with a color developer, to thereby produce a given single-color (cyan, magenta, yellow). Accordingly, in this case, the color developer is contained in the binder, which forms a part of the layer of microcapsules (14, 44, 54).

Finally, it will be understood by those skilled in the art that the foregoing description is of preferred embodiments of the image-forming substrate, and that various changes and modifications may be made to the present invention without departing from the spirit and scope thereof.

The present disclosure relates to subject matter contained in Japanese Patent Application Nos. 10-231751 (filed on Aug. 18, 1998) and 11-057698 (filed on Mar. 4, 1999) which are expressly incorporated herein, by reference, in their entireties.

What is claimed is:

1. A method of discharging ink from an image-forming substrate comprising:

providing an ink-forming substrate comprising:

a base member, and a layer of microcapsules coated over the base member, the microcapsules comprising shells filled with solid ink;

squashing and breaking the shells of the microcapsules under a predetermined pressure when the solid ink of each microcapsule is thermally melted at a predetermined temperature to discharge thermally-molten ink from the squashed and broken microcapsules.

2. An image-forming substrate comprising:

a base member;

a layer of microcapsules coated over the base member, the microcapsules being filled with solid ink; and shells of the microcapsules being constituted so as to be squashed and broken under a predetermined pressure when the solid ink of the microcapsules is thermally melted at a predetermined temperature to discharge thermally-molten ink from the squashed and broken microcapsules, and wherein an outer surface of the shells of the microcapsules is colored by a same single color pigment as a single color of the base member.

3. The image-forming substrate of claim 2, wherein the solid ink comprises pigment and a vehicle that disperses the pigment.

4. The image-forming substrate of claim 3, wherein the vehicle comprises wax material.

5. The image-forming substrate of claim 4, wherein the wax material comprises one of carnauba wax, olefin wax, polypropylene wax, microcrystalline wax, paraffin wax, and montan wax.

6. The image-forming substrate of claim 3, wherein the vehicle comprises thermoplastic resin material having a low-melting point.

7. The image-forming substrate of claim 6, wherein the low-melting point thermoplastic resin material comprises one of ethylene-vinyl acetate copolymer, polyethylene, polyester, and styrene-methylmethacrylate copolymer.

8. The image-forming substrate of claim 3, wherein the pigment comprises one of phthalocyanine blue, rhodamine lake T, and benzine yellow G.

9. The image-forming substrate of claim 2, wherein the shells of the microcapsules comprise thermosetting resin material.

10. The image-forming substrate of claim 9, wherein the thermosetting resin material comprises one of melamine resin and urea resin.

11. The image-forming substrate of claim 2, wherein the shells of the microcapsules comprise thermoplastic resin material having a high-melting point which is considerably higher than the predetermined temperature.

12. The image-forming substrate of claim 11, wherein the high-melting thermoplastic resin material comprises one of polyamide and polyimide.

13. The image-forming substrate of claim 2, wherein the shells of the microcapsules comprise inorganic material.

14. The image-forming substrate of claim 13, wherein the inorganic material comprises one of titanium dioxide and silica.

15. An image-forming substrate comprising:

a base member;

a layer of microcapsules coated over the base member, the microcapsules comprising first microcapsules filled with first monochromatic solid ink and second microcapsules filled with second monochromatic solid ink;

shells of the first microcapsules being constituted so as to be squashed and broken under a first predetermined pressure when the first monochromatic solid ink of the first microcapsules is thermally melted at a first predetermined temperature to discharge thermally-molten ink from the squashed and broken first microcapsules; and shells of the second microcapsules being constituted so as to be squashed and broken under a second predetermined pressure when the second monochromatic solid ink of the second microcapsules is thermally melted at a second predetermined temperature to discharge thermally-molten ink from the squashed and broken second microcapsules, wherein the first predetermined temperature is lower than the second predetermined temperature, and the first predetermined pressure is higher than the second predetermined pressure, so that the first and second microcapsules are capable of being selectively squashed and broken within a localized area of the layer of microcapsules by selectively exerting a first set of the first predetermined temperature and the first predetermined pressure and a second set of the second predetermined temperature and the second predetermined pressure on the localized area of the layer of microcapsules.

16. The image-forming substrate of claim 15, wherein the first monochromatic solid ink comprises first pigment and a first vehicle dispersing the first pigment, and the second monochromatic solid ink comprises second pigment and a second vehicle dispersing the second pigment.

17. The image-forming substrate of claim 16, wherein the first vehicle comprises first wax material, and the second vehicle comprises second wax material having a melting point higher than a melting point of the first wax material.

18. The image-forming substrate of claim 16, wherein the first vehicle comprises first low-melting thermoplastic resin material, and the second vehicle comprises second low-melting thermoplastic resin material having a melting point higher than a melting point of the first low-melting thermoplastic resin material.

19. The image-forming substrate of claim 15, wherein the shells of the first and second microcapsules are formed of a same material, and a thickness of the shells of the first microcapsules is thicker than a thickness of the shells of the second microcapsules such that the shells of the first microcapsules are durable against the second predetermined pressure, without being squashed and broken, under the second predetermined temperature.

20. The image-forming substrate of claim 15, wherein the shells of the first and second microcapsules comprise thermosetting resin material.

21. The image-forming substrate of claim 15, wherein the shells of the first and second microcapsules comprise thermoplastic resin material having a high-melting point which is considerably higher than the first and second predetermined temperatures.

22. The image-forming substrate of claim 15, wherein the shells of the first and second microcapsules comprise inorganic material.

23. The image-forming substrate of claim 15, wherein an outer surface of the shells of the first and second microcapsules is colored by a same single color pigment as a single color exhibited by the base member.

24. An image-forming substrate comprising:

a base member;

a layer coated over the base member, the layer comprising microcapsules filled with solid ink having a first monochrome and a plurality of solid ink particles having a second monochrome;

shells of the microcapsules being constituted so as to be squashed and broken under a predetermined pressure when the solid ink is thermally melted at a first predetermined temperature to discharge thermally-molten ink from the squashed and broken microcapsules; and the solid ink particles being constituted so as to be thermally broken and melted under a second predetermined temperature higher than the first predetermined temperature, without being subjected to substantial pressure.

25. The image-forming substrate of claim 24, wherein the solid ink comprises first pigment and a first vehicle dispersing the first pigment, and the solid ink particles comprise second pigment and a second vehicle dispersing the second pigment and having a higher melting point than a melting point of the first vehicle.

26. The image-forming substrate of claim 25, wherein the first vehicle comprises first wax material, and the second vehicle comprises thermoplastic resin material having a higher melting point than a melting point of the first wax material.

27. The image-forming substrate of claim 26, wherein the first wax material comprises one of camauba wax and olefin wax, and the thermoplastic resin material comprises styrene-methylmethacrylate copolymer.

28. The image-forming substrate of claim 24, wherein the shells of the microcapsules comprise thermosetting resin material.

29. The image-forming substrate of claim 24, wherein the shells of the microcapsules comprise thermoplastic resin material having a high-melting point which is considerably higher than the first predetermined temperature.

30. The image-forming substrate of claim 24, wherein the shells of the microcapsules comprise inorganic material.

31. The image-forming substrate of claim 24, wherein an outer surface of the shells of the microcapsules and an outer surface of the solid ink particles are colored by a same single color pigment as a single color of the base member.

32. An image-forming substrate comprising:

a base member;

a layer of microcapsules coated over the base member, the layer of microcapsules comprising first microcapsules filled with first solid ink of a first color and second microcapsules filled with second solid ink of the same first color;

shells of the first microcapsules being constituted so as to be squashed and broken under a first predetermined pressure when the first solid ink is thermally melted at a first predetermined temperature to discharge thermally-molten first solid ink of the first color from the squashed and broken first microcapsules; and shells of the second microcapsules being constituted so as to be squashed and broken under the first predetermined pressure when the second solid ink is thermally melted at a second predetermined temperature to discharge thermally-molten second solid ink of the first color from the squashed and broken second microcapsules, wherein the first predetermined temperature is lower than the second predetermined temperature, so that the first and second microcapsules are capable of being selectively squashed and broken within a localized area of the layer of microcapsules by selectively exerting a set of the first predetermined temperature and the first predetermined pressure and a set of the second predetermined temperature and the first predetermined pressure on the localized area of the layer of microcapsules, resulting in a variation in density of the first and second solid inks of the first color discharged within the localized area of the layer of microcapsules.

33. The image-forming substrate of claim 32, wherein the first solid ink has a same density as a density of the second solid ink.

34. The image-forming substrate of claim 32, wherein the first solid ink has a density different from a density of the second solid ink.

35. The image-forming substrate of claim 32, wherein the layer of microcapsules further comprises third microcapsules filled with third solid ink of a second color and fourth microcapsules filled with fourth solid ink of the same second color, shells of the third microcapsules being constituted so as to be squashed and broken under a second predetermined pressure when the third solid ink of the second color is thermally melted at a third predetermined temperature to discharge thermally-molten third solid ink from the squashed and broken third microcapsules, shells of the fourth microcapsules being constituted so as to be squashed and broken under the second predetermined pressure when the fourth solid ink of the second color is thermally melted at a fourth predetermined temperature to discharge thermally-molten fourth solid ink of the second color from the squashed and broken fourth microcapsules, wherein the third predetermined temperature is lower than the fourth predetermined temperature, so that the third and fourth microcapsules are capable of being selectively squashed and broken within a localized area of the layer of microcapsules by selectively exerting a set of the third predetermined temperature and the second predetermined pressure and a set of the fourth predetermined temperature and the second predetermined pressure on the localized area of the layer of microcapsules, resulting in a variation in density of the third and fourth solid inks of the second color discharged within the localized area of the layer of microcapsules.

36. The image-forming substrate of claim 35, wherein the third solid ink has a same density as a density of the fourth solid ink.

37. The image-forming substrate of claim 35, wherein the third solid ink has a density different from a density of the fourth solid ink.

38. An image-forming substrate comprising:

a base member;

a layer of microcapsules coated over the base member, the layer of microcapsules comprising first microcapsules filled with first solid ink of a first color and second microcapsules filled with second solid ink of the same first color;

shells of the first microcapsules being constituted so as to be squashed and broken under a first predetermined pressure when the first solid ink is thermally melted at a first predetermined temperature to discharge thermally-molten first solid ink of the first color from the squashed and broken first microcapsules; and shells of the second microcapsules being constituted so as to be squashed and broken under a second predetermined pressure when the second solid ink is thermally melted at a second predetermined temperature to discharge thermally-molten second solid ink from the squashed and broken second microcapsules, wherein the first predetermined temperature is lower than the second predetermined temperature, and the first predetermined pressure is higher than the second predetermined pressure, so that the first and second microcapsules are capable of being selectively squashed and broken within a localized area of the layer of microcapsules by selectively exerting a set of the first predetermined temperature and the first predetermined pressure and a set of the second predetermined temperature and the second predetermined pressure on the localized area of the layer of microcapsules, resulting in a variation in density of the first and second solid inks of the first color discharged within the localized area of the layer of first and second microcapsules.

39. The image-forming substrate of claim 38, wherein the first solid ink has a same density as a density of the second solid ink.

40. The image-forming substrate of claim 38, wherein the first solid ink has a density different from a density of the second solid ink.

41. The image-forming substrate of claim 38, wherein the layer of microcapsules further comprises third microcapsules filled with third solid ink of a second color and fourth microcapsules filled with fourth solid ink of the same second color, shells of the third microcapsules being constituted so as to be squashed and broken under a third predetermined pressure when the third solid ink is thermally melted at a third predetermined temperature to discharge thermally-molten third solid ink of the second color from the squashed and broken third microcapsules, shells of the fourth microcapsules being constituted so as to be squashed and broken under a fourth predetermined pressure when the fourth solid ink is thermally melted at a fourth predetermined temperature to discharge thermally-molten fourth solid ink of the second color from the squashed and broken fourth microcapsules, wherein the third predetermined temperature is lower than the fourth predetermined temperature, and the third predetermined pressure is higher than the fourth predetermined pressure, so that the third and fourth microcapsules are capable of being selectively squashed and broken within a localized area of the layer of microcapsules by selectively exerting a set of the third predetermined temperature and the third predetermined pressure and a set of the fourth predetermined temperature and the fourth predetermined pressure on the localized area of the layer of microcapsules, resulting in a variation in density of the third and fourth solid inks of the second color discharged within the localized area of the layer of microcapsules.

42. The image-forming substrate of claim 41, wherein the third solid ink has a same density as a density of the fourth solid ink.

43. The image-forming substrate of claim 41, wherein the third solid ink has a density different from a density of the fourth solid ink.

44. An image-forming substrate comprising:

a base member, a layer of microcapsules coated over the base member, the layer of microcapsules comprising first microcapsules filled with first monochromatic solid ink having a melting point which falls within a first predetermined range of temperature; and shells of the first microcapsules being constituted so as to be squashed and broken under a first predetermined pressure when the first monochromatic solid ink, encapsulated in the shells of the first microcapsules, is thermally melted under a temperature within the first predetermined range of temperature to discharge thermally-molten first monochromatic solid ink from the squashed and broken first microcapsules, wherein the first microcapsules are capable of being selectively squashed and broken within a localized area of the layer of microcapsules, on which the first predetermined pressure is exerted, by regulating a temperature to be exerted on the localized area of the layer of microcapsules within the first predetermined range of temperature, resulting in a variation in density of the first monochromatic solid ink discharged within the localized area of the layer of microcapsules.

45. The image-forming substrate of claim 44, wherein the first microcapsules are capable of being completely squashed and broken within the localized area of the layer of microcapsules when a maximum temperature, within the first predetermined range of temperature, is exerted on the localized area of the layer of microcapsules.

46. The image-forming substrate of claim 44, wherein the layer of microcapsules further comprises second microcapsules filled with second monochromatic solid ink having a melting point which falls within a second predetermined range of temperature, shells of the second microcapsules being constituted so as to be squashed and broken under a second predetermined pressure when the second monochromatic solid ink, encapsulated in the shells of the second microcapsules, is thermally melted under a temperature within the second predetermined range of temperature to discharge thermally-molten second monochromatic solid ink from the squashed and broken second microcapsules, wherein the second microcapsules are capable of being selectively squashed and broken within a localized area of the layer of microcapsules, on which the second predetermined pressure is exerted, by regulating a temperature to be exerted on the localized area of the layer of microcapsules within the second predetermined range of temperature, resulting in a variation in density of the second monochromatic solid ink discharged within the localized area of the layer of microcapsules.

47. The image-forming substrate of claim 46, wherein the second microcapsules are capable of being completely squashed and broken within the localized area of the layer of microcapsules when a maximum temperature, within the second predetermined range of temperature, is exerted on the localized area of the layer of microcapsules.

48. The image-forming substrate of claim 46, wherein the second monochromatic solid ink comprises a mixture of at least two solid ink materials having a same color and having different melting points, and a mixture ratio one of the at least two solid ink materials varies among the second monochromatic solid inks encapsulated in individual microcapsules in the second microcapsules.

49. The image-forming substrate of claim 44, wherein the second monochromatic solid ink comprises a mixture of at least two solid ink materials having a same color and having different melting points, and a mixture ratio one of the at least two solid ink materials varies among the second monochromatic solid inks encapsulated in individual microcapsules in the second microcapsules.

50. A method of discharging ink from a microcapsule comprising:

providing a microcapsule comprising a shell filled with solid ink having a predetermined melting point;

squashing and breaking the shell of the microcapsule under a predetermined pressure when the solid ink of the microcapsule is thermally melted at a predetermined temperature to discharge thermally-molten ink from the squashed and broken microcapsule.

51. A microcapsule comprising:

a shell element; and a solid ink encapsulated in the shell element, the solid ink having a predetermined melting point, wherein the shell element is constituted so as to be squashed and broken at a predetermined temperature when the solid ink is thermally melted at the predetermined temperature, and wherein the shell element comprises inorganic material.

52. The microcapsule of claim 51, wherein the solid ink comprises pigment and a vehicle dispersing the pigment.

53. The microcapsule of claim 52, wherein the vehicle comprises wax material.

54. The microcapsule of claim 53, wherein the wax material comprises one of carnauba wax, olefin wax, polypropylene wax, microcrystalline wax, paraffin wax, and montan wax.

55. The microcapsule of claim 52, wherein the vehicle comprises thermoplastic resin material having a low-melting point.

56. The microcapsule of claim 55, wherein the low-melting thermoplastic resin material comprises one of ethylene-vinyl acetate copolymer, polyethylene, polyester, and styrene-methylmethacrylate copolymer.

57. The microcapsule of claim 52, wherein the pigment comprises one of phthalocyanine blue, rhodamine lake T, and benzine yellow G.

58. The microcapsule of claim 51, wherein the shell element comprises thermosetting resin material.

59. The microcapsule of claim 58, wherein the thermosetting resin material comprises one of melamine resin and urea resin.

60. The microcapsule of claim 51, wherein the shell element comprises thermoplastic resin material.

61. The microcapsule of claim 60, wherein the thermoplastic resin material comprises one of polyamide and polyimide.

62. The microcapsule of claim 51, wherein the inorganic material comprises one of titanium dioxide and silica.

* * * * *